US008504378B2

(12) United States Patent
Liu et al.

(10) Patent No.: US 8,504,378 B2
(45) Date of Patent: Aug. 6, 2013

(54) STEREO ACOUSTIC SIGNAL ENCODING APPARATUS, STEREO ACOUSTIC SIGNAL DECODING APPARATUS, AND METHODS FOR THE SAME

(75) Inventors: Zongxian Liu, Singapore (SG); Kok Seng Chong, Singapore (SG)

(73) Assignee: Panasonic Corporation, Osaka (JP)

( * ) Notice: Subject to any disclaimer, the term of this patent is extended or adjusted under 35 U.S.C. 154(b) by 34 days.

(21) Appl. No.: 13/145,514

(22) PCT Filed: Jan. 21, 2010

(86) PCT No.: PCT/JP2010/000331

§ 371 (c)(1),
(2), (4) Date: Jul. 20, 2011

(87) PCT Pub. No.: WO2010/084756

PCT Pub. Date: Jul. 29, 2010

(65) Prior Publication Data

US 2011/0288872 A1 Nov. 24, 2011

(30) Foreign Application Priority Data

Jan. 22, 2009 (JP) ..... 2009-012407
Feb. 20, 2009 (JP) ..... 2009-038646

(51) Int. Cl.
*G10L 19/00* (2013.01)

(52) U.S. Cl.
USPC ..... 704/503; 704/500

(58) Field of Classification Search
USPC ..... 704/500
See application file for complete search history.

(56) References Cited

U.S. PATENT DOCUMENTS 5,300,825 A * 4/1994 Inoue et al. ..... 725/36
5,664,055 A * 9/1997 Kroon ..... 704/223

(Continued)

FOREIGN PATENT DOCUMENTS

JP 2/055431 2/1990
JP 07/240722 9/1995

(Continued)

OTHER PUBLICATIONS

Caron et al , "A Method for Detecting Artificial Objects in Natural Environments" LNE3I—Universite de Tours—64, av. J. Porralis—37200 Tours—France.*

(Continued)

*Primary Examiner* — Jialong He
*Assistant Examiner* — Jie Shan
(74) *Attorney, Agent, or Firm* — Dickinson Wright PLLC

(57) ABSTRACT

Disclosed is a stereo acoustic signal encoding apparatus in which the signal quality does not deteriorate if there are a plurality of sound sources. A peak tracing unit (401) splits frames of a right channel signal and a left channel signal into a plurality of sub frames; detects the peaks of wave shapes of the split sub frames; and estimates a frame delay time D for each frame of the right channel signal and the left channel signal by comparing the positions of the detected peaks. A time adjusting unit (402) adjusts the time of the right channel signal on the basis of the frame time delay D. A down-mix operation is carried out using the right channel signal which has been subjected to the time adjustment and the left channel signal to generate a mono signal and a sub signal. A mono signal encoding unit (403) encodes the mono signal. A sub signal encoding unit (404) encodes the sub signal. The time delay encoding unit (405) encodes the frame time delay D.

11 Claims, 27 Drawing Sheets

(56) References Cited

U.S. PATENT DOCUMENTS

| | | | | |
|---|---|---|---|---|
| 5,704,003 | A * | 12/1997 | Kleijn et al. | 704/220 |
| 5,845,244 | A * | 12/1998 | Proust | 704/200.1 |
| 2001/0003812 | A1* | 6/2001 | Ehara et al. | 704/207 |
| 2002/0095284 | A1* | 7/2002 | Gao | 704/219 |
| 2005/0010400 | A1* | 1/2005 | Murashima | 704/219 |
| 2007/0180980 | A1* | 8/2007 | Kim | 84/612 |
| 2007/0204744 | A1* | 9/2007 | Sako et al. | 84/612 |
| 2008/0063098 | A1* | 3/2008 | Lai et al. | 375/260 |
| 2008/0154583 | A1* | 6/2008 | Goto et al. | 704/205 |
| 2008/0253576 | A1* | 10/2008 | Choo et al. | 381/10 |
| 2009/0119111 | A1 | 5/2009 | Goto | |
| 2009/0276210 | A1 | 11/2009 | Goto | |
| 2011/0142177 | A1* | 6/2011 | Kang et al. | 375/340 |

FOREIGN PATENT DOCUMENTS

| | | |
|---|---|---|
| JP | 2006-304125 | 11/2006 |
| WO | 2004/008806 | 1/2004 |
| WO | 2007/052612 | 2/2007 |
| WO | 2007/116809 | 10/2007 |

OTHER PUBLICATIONS

3GPP TS 26.290 V6.0.0, "Technical Specification Group Service and System Aspects; Audio codec processing functions; Extended AMR Wideband codec; Transcoding functions (Release 6)," Sep. 2009, pp. 1-86.

J. Lindblom, et al., "Flexible Sum-Difference Stereo Coding Based on Time-Aligned Signal Components," IEEE Workshop on Applications of Signal Processing to Audio and Acoustics, Oct. 16-19, 2005, pp. 255-258.

C. Faller, et al., "Binaural Cue Coding—Part II: Schemes and Applications," IEEE Transactions on Speech and Audio Processing, vol. 11, No. 6, Nov. 2003, pp. 520-531.

* cited by examiner

STEREO ACOUSTIC SIGNAL ENCODING APPARATUS, STEREO ACOUSTIC SIGNAL DECODING APPARATUS, AND METHODS FOR THE SAME

TECHNICAL FIELD

The present invention relates to a stereo acoustic signal encoding apparatus, a stereo acoustic signal decoding apparatus, and methods for the same.

BACKGROUND ART

With a global drift towards broadband, expectations of users for communication systems have increased from just clarity to stereo feeling and naturalness. Accordingly, stereo acoustic sound signals have been provided as a trend. As a result, an effective encoding method has been desired for storing and transmitting stereo acoustic sound signals.

As the stereo encoding method, for example, there are a number of stereo encoding methods which adopt Mid-Side (sum-difference) (hereinafter referred to as M/S) and use the redundancy of stereo included in stereo signals, like extended adaptive multi-rate-wideband (AMR-WB+) (for example, Non-Patent Literature 1).

In M/S stereo encoding, in many cases, since a correlation between two channels is considerably high, the sum and difference between two signals (a left channel signal and a right channel signal) are computed. As a result, the redundancy of two signals is eliminated, and then a sum (monaural or mid) signal and a difference (sub or side) signal are encoded. Therefore, it is possible to allocate (relatively) more bits to the monaural signal having high energy than the side signal having low energy, and to implement high-quality stereo acoustic sound signals.

A problem of the M/S method using the redundancy of stereo acoustic sound signals is that, in a case the phases of two components are deviated from each other (one side is temporally delayed with respect to the other side), merits of the M/S encoding are lost. Since time delays frequently occur in actual audio signals, this is a fundamental matter. Also, a stereoscopic effect perceived when a stereo signal is listened depends heavily on a temporal difference between a left channel signal and a right channel signal (particularly, at a low frequency).

In order to solve this problem, in Non-Patent Literature 2, an adaptive M/S stereo encoding method in which a phase is based on a time-aligned signal component has been proposed.

FIG. 1 is a block diagram illustrating a configuration of an encoding apparatus based on a principle of an adaptive M/S stereo encoding method for stereo signals.

In an encoding process of the encoding apparatus shown in FIG. 1, time delay estimation section 101 estimates time delay D corresponding to a time delay between left channel L(n) and right channel R(n) of a stereo signal by using a time domain cross correlation technique, like equation 1.

Equation 1

$$C_{LR}(\tau) = \frac{\left(\sum_{n=0}^{N-1-\tau} L(n)R(n+\tau)\right)^2}{\left(\sum_{n=0}^{N-1-\tau} L^2(n)\right) * \left(\sum_{n=0}^{N-1-\tau} R^2(n+\tau)\right)} \quad [1]$$

and $$D = \underset{\tau}{argmax}\, C_{LR}(\tau)$$

$$\tau \in [a, b]$$

In equation 1, [a, b] represents a predetermined range, and N represents a frame size.

Time delay encoding section 105 encodes time delay D, and multiplexing section 106 multiplexes encoded parameters so as to form a bit stream.

Next, time alignment section 102 aligns right channel signal R(n) according to time delay D. The aligned right channel signal is denoted by $R_a(n)$.

Down mix is performed on the aligned signal component so as to obtain monaural signal M(n) and side signal. S(n), like equation 2.

Equation 2

$$\begin{cases} M(n) = L(n) + R_a(n) \\ S(n) = L(n) - R_a \end{cases} \quad [2]$$

From equation 2, a temporally aligned signal can be generated according to equation 3.

Equation 3

$$\begin{cases} R_a(n) = 0.5^*(M(n) - S(n)) \\ L(n) = 0.5^*(M(n) + S(n)) \end{cases} \quad [3]$$

Monaural encoding section 103 encodes monaural signal M(n), and side signal encoding section 104 encodes side signal S(n). Multiplexing section 106 multiplexes the encoded parameters input from both sides of monaural encoding section 103 and side signal encoding section 104, so as to form the bit stream.

FIG. 2 is a block diagram illustrating a configuration of a decoding apparatus based on the principle of the adaptive M/S stereo encoding method for stereo signals.

In a decoding process shown in FIG. 2, de-multiplexing section 201 separates all of the encoded parameters and quantized parameters from the bit stream. Specifically, monaural decoding section 202 decodes the encoded parameters of the monaural signal so as to obtain a decoded monaural signal. Further, side signal decoding section 203 decodes the encoded parameters of the side signal so as to obtain a decoded side signal. Furthermore, time delay decoding section 204 decodes the encoded time delay so as to obtain decoded time delay D.

Next, a stereo signal is generated according to equation 4 by using the decoded monaural signal and the decoded side signal.

Equation 4

$$\begin{cases} \tilde{R}_a(n) = 0.5 * (\tilde{M}(n) - \tilde{S}(n)) \\ \tilde{L}(n) = 0.5 * (\tilde{M}(n) + \tilde{S}(n)) \end{cases} \quad [4]$$

where:

$\tilde{M}(n)$ represents the decoded monaural signal;

$\tilde{S}(n)$ represents the decoded side signal; and $\tilde{R}_a(n)$ represents the input signal of time restoring section 205.

Time restoring section 205 de-aligns the phase of the input signal of time restoring section 205 in a reverse direction by using decoded time delay D, so as to obtain an output signal of time restoring section 205.

CITATION LIST

Non-Patent Literature

NPL 1

Extended AMR Wideband Codec (AMR-WB+): Transcoding functions, 3GPP TS 26.290.

NPL 2

Jonas Lindblom, Jan H. Plasberg and Renat Vafin "Flexible Sum-difference Stereo Coding Based on Time-aligned Signal Components," IEEE Workshop on Application of Signal Processing to Audio and Acoustics, 2005.

NPL3

C. Faller and F. Baumgarte, "Binaural cue coding-part Schemes and applications," IEEE Trans. Speech Audio Processing, vol. 11, no. 6, pp. 520-531, 2003

SUMMARY OF INVENTION

Technical Problem

The method of Non-Patent Literature 2 functions well on the assumption that input signals are from a single sound source; however, it does not function successively in a case where there are a plurality of sound sources (for example, voices by a plurality of speakers, music by a plurality of different musical instruments, a voice or music with background noise, etc.).

In the case where there are a plurality of sound sources, a time delay cannot be accurately calculated by a cross-correlation method, which may result in a deterioration of the quality of a signal. In the worst case, the stereo feeling becomes unstable. It has been reported that, according to Non-Patent Literature 2, the stereo feeling was unstable in some tests.

Here, in the case of a single sound source, a signal of the sound source is denoted by $s_1(n)$. In this case, a stereo signal can be expressed as equation 5.

Equation 5

$$\begin{cases} L(n) = A_L * s_1(n - D_L) + N_L(n) \\ R(n) = A_R * s_1(n - D_R) + N_R(n) \end{cases} \quad [5]$$

where:

$A_L$ represents an attenuation factor until $s_1(n)$ reaches a left channel sound recording apparatus;

$A_R$ represents an attenuation factor until $s_1(n)$ reaches a right channel sound recording apparatus;

$D_L$ represents an arrival time until $s_1(n)$ reaches the left channel sound recording apparatus;

$D_R$ represents an arrival time until $s_1(n)$ reaches the right channel sound recording apparatus;

$N_L$ represents background noise in the left channel sound recording apparatus; and $N_R$ represents background noise in the right channel sound recording apparatus.

If the background noise is ignorable in both sides of the left channel sound recording apparatus and the right channel sound recording apparatus in equation 5, the stereo signal can be expressed as equation 6.

Equation 6

$$\begin{cases} L(n) = A_L * s_1(n - D_L) \\ R(n) = A_R * s_1(n - D_R) \end{cases} \quad [6]$$

In this case, R(n) can be expressed by using L(n), as equation 7.

Equation 7

$$R(n) = \left(\frac{A_R}{A_L}\right) * L(n - (D_R - D_L)) \quad [7]$$

If the background noise is ignorable in the case of a signal sound source, from equation 7, one channel (for example, R(n)) of the stereo signal can be regarded as obtained by delaying and attenuating the other channel (L(n)). Therefore, it can be said that the adaptive M/S encoding method functions effectively.

Meanwhile, in the case where there are a plurality of sound sources, it is assumed that M sound sources exist and are denoted by $s_1(n)$ to $s_M(n)$. In this case, the stereo signal can be expressed as equation 8.

Equation 8

$$\begin{cases} L(n) = \sum_{i=1}^{M} A_{Li} * s_i(n - D_{Li}) + N_L(n) \\ R(n) = \sum_{i=1}^{M} A_{Ri} * s_i(n - D_{Ri}) + N_R(n) \end{cases} \quad [8]$$

where:

$A_{Li}$ represents an attenuation factor until $s_i(n)$ reaches a left channel sound recording apparatus;

$A_{Ri}$ represents an attenuation factor until $s_i(n)$ reaches a right channel sound recording apparatus;

$D_{Li}$ represents an arrival time until $s_i(n)$ reaches the left channel sound recording apparatus;

$D_{Ri}$ represents an arrival time until $s_i(n)$ reaches the right channel sound recording apparatus;

$N_L(n)$ represents background noise in the left channel sound recording apparatus; and $N_R(n)$ represents background noise in the right channel sound recording apparatus.

If the background noise is ignorable in both sides of the left channel sound recording apparatus and the right channel sound recording apparatus in equation 8, the stereo signal can be expressed as equation 9.

Equation 9

$$\begin{cases} L(n) = \sum_{i=1}^{M} A_{Li} * s_i(n - D_{Li}) \\ R(n) = \sum_{i=1}^{M} A_{Ri} * s_i(n - D_{Ri}) \end{cases} \quad [9]$$

In the case where there are a plurality of sound sources, unlike the case of a single sound source, even when the background noise is ignorable, from equation 9, one channel (for example, right channel signal R(n)) of the stereo signal cannot be regarded as obtained by delaying and attenuating the other channel (left channel signal L(n)). Therefore, it can be said that the adaptive encoding method is not effective in the case where there are a plurality of sound sources.

An object of the present invention is to provide a stereo acoustic sound signal encoding apparatus, a stereo acoustic sound signal decoding apparatus, and methods for the same, capable of remarkably reducing an amount of computational complexity by using only peak information, as compared to a time estimation method according to the related art which uses a cross correlation or another time estimation method according to the related art which uses a time-to-frequency transform.

Solution to Problem

The stereo acoustic sound signal encoding apparatus according to an embodiment of the present invention includes: a peak tracking section that divides a frame of a right channel signal and a left channel signal into a plurality of sub frames, detects peaks in waveforms of the divided sub frames, and compares the positions of the detected peaks, thereby estimating a frame time delay of each frame of the right channel signal and the left channel signal; a time alignment section that performs time alignment on one of the right channel signal and the left channel signal on the basis of the frame time delay; and an encoding section that encodes the other of the right channel signal and the left channel signal, the time-aligned one of the right channel signal and the left channel signal, and the frame time delay.

A stereo acoustic sound signal decoding apparatus comprising: a separation section that separates a bit stream into a right channel signal, a left channel signal, and a frame time delay, the bit stream generated by dividing a frame of the right channel signal and the right channel signal into a plurality of sub frames, detecting peaks in waveforms of the divided sub frames, estimates the frame time delay of each frame of the right channel signal and the left channel signal by comparing the positions of the detected peaks, performing time alignment on one of the right channel signal and the left channel signal on the basis of the frame time delay, and encoding and multiplexing the other of the right channel signal and the left channel signal, the time-aligned one of the right channel signal and the left channel signal, and the frame time delay; a decoding section that decodes the separated right channel signal, the separated left channel signal, and the separated frame time delay; and a time restoring section that restores the right channel signal to a time before the time alignment, on the basis of the separated frame time delay.

The stereo acoustic sound signal encoding method according to an embodiment of the present invention includes the steps of: dividing a frame of a right channel signal and a left channel signal into a plurality of sub frames, detecting peaks in waveforms of the divided sub frames, and comparing the positions of the detected peaks, thereby estimating a frame time delay of each frame of the right channel signal and the left channel signal; performing time alignment on one of the right channel signal and the left channel signal on the basis of the frame time delay; and encoding the other of the right channel signal and the left channel signal, the time-aligned one of the right channel signal and the left channel signal, and the frame time delay.

The stereo acoustic sound signal decoding method according to an embodiment of the present invention includes the steps of: separating a bit stream into a right channel signal, a left channel signal, and a frame time delay, the bit stream generated by dividing a frame of the right channel signal and the right channel signal into a plurality of sub frames, detecting peaks in waveforms of the divided sub frames, estimates the frame time delay of each frame of the right channel signal and the left channel signal by comparing the positions of the detected peaks, performing time alignment on one of the right channel signal and the left channel signal on the basis of the frame time delay, and encoding and multiplexing the other of the right channel signal and the left channel signal, the time-aligned one of the right channel signal and the left channel signal, and the frame time delay; decoding the separated right channel signal, the separated left channel signal, and the separated frame time delay; and restoring the right channel signal to a time before the time alignment, on the basis of the separated frame time delay.

Advantageous Effects of Invention

According to the present invention, since only peak information is used, it is possible to remarkably reduce an amount of computational complexity, as compared to a time estimation method according to the related art which uses a cross correlation or another time estimation method according to the related art which uses a time-to-frequency transform.

DESCRIPTION OF EMBODIMENTS

Figure 1:
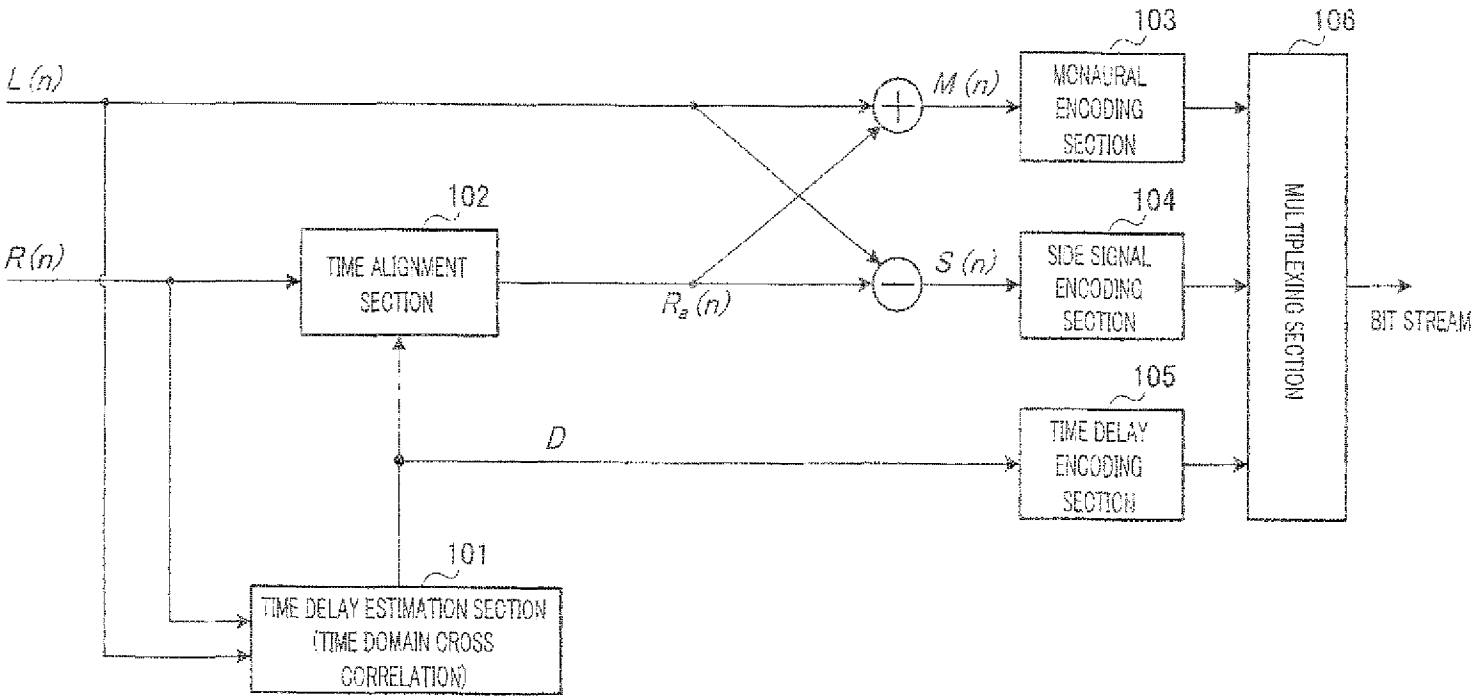
RELATED ART FIG. 1
FIG. 1 is a block diagram illustrating a configuration of an encoding apparatus according to the related art.
Figure 2:
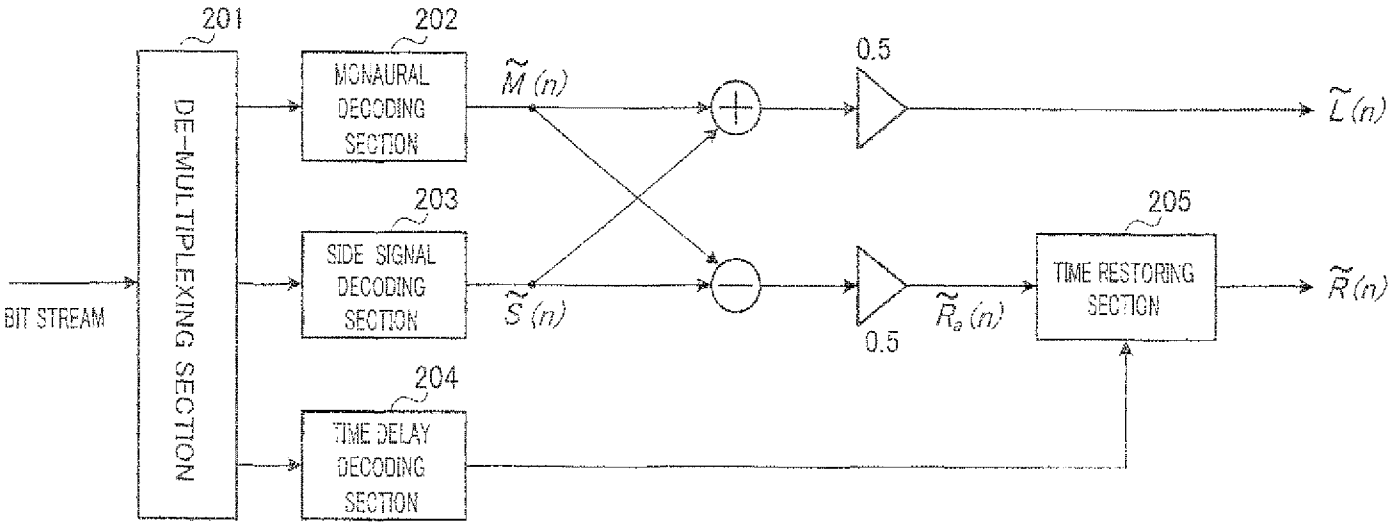
RELATED ART FIG.2
FIG. 2 is a block diagram illustrating a configuration of a decoding apparatus according to the related art.

The present invention relates to a peak tracking method. The peak tracking is a method of estimating a time delay between a left channel signal and a right channel signal by using a waveform characteristic of a stereo input signal. The peak tracking is also usable for checking on the validity of a time delay derived from a cross correlation method or another time delay estimation method.

An uttered voice can be modelized as a signal output as a result when a time-varying vocal tract system is excited by a time-varying excitation signal. In general, a main form exciting the vocal tract system is the vibration of vocal cords (hereinafter referred to as glottal vibration). An excitation signal generated by the glottal vibration can be approximated by an sequence of impulses.

In the case of a single sound source, as described in 'Technical Problem', if the background noise is ignorable, one channel (for example, right channel signal R(n)) can be regarded as a signal obtained by delaying and attenuating the other channel (left channel signal (L(n)).

Therefore, a time-varying excitation signal (referred to as a first sequence of impulses) of right channel signal R(n) can be regarded as a signal obtained by delaying and attenuating a time-varying excitation signal (referred to as a second sequence of impulses) of left channel signal L(n).

On the basis of the above-mentioned principle, in the peak tracking method, a time delay is estimated by comparing the positions of corresponding pulses in the first sequence of impulses and the second sequence of impulses.

However, in most of the cases where there are a plurality of sound sources, as described in 'Technical Problem', one channel (for example, R(n)) of the stereo signal cannot be regarded as a signal obtained by delaying and attenuating the other channel (L(n ). This will be described with reference to FIG. 3 in detail.

Here, a case where there are two speakers speaking at the same time is considered. Two signals are denoted by $s_1(n)$ and $s_2(n)$, and excitation signals thereof are denoted by $exc_1(n)$ and $exc_2(n)$. In this case, a stereo signal can be expressed as equation 10.

Equation 10

$$\begin{cases} L(n) = A_{L1} * s_1(n - D_{L1}) + A_{L2} * s_2(n - D_{L2}) + N_L(n) \\ R(n) = A_{R1} * s_1(n - D_{R1}) + A_{R2} * s_2(n - D_{R2}) + N_R(n) \end{cases} \quad [10]$$

where:

$A_{Li}$ represents an attenuation factor until $s_i(n)$ reaches a left channel sound recording apparatus;

$A_{Ri}$ represents an attenuation factor until $s_i(n)$ reaches a right channel sound recording apparatus;

$D_{Li}$ represents an arrival time until $s_i(n)$ reaches the left channel sound recording apparatus;

$D_{Ri}$ represents an arrival time until $s_i(n)$ reaches the right channel sound recording apparatus;

$N_L(n)$ represents background noise in the left channel sound recording apparatus; and $N_R(n)$ represents background noise in the right channel sound recording apparatus.

Left channel excitation signal $exc_L(n)$ and right channel excitation signal $exc_R(n)$ can be expressed by using the excitation signal $exc_1(n)$ of the first speaker and the excitation signal $exc_2(n)$ of the second speaker, as equation 11.

Equation 11

$$\begin{cases} exc_L(n) = exc_1(n - D_{L1}) + exc_2(n - D_{L2}) \\ exc_R(n) = exc_1(n - D_{R1}) + exc_2(n - D_{R2}) \end{cases} \quad [11]$$

In general, in equation 11, a pattern of $exc_L(n)$ is different from a pattern of $exc_R(n)$. If the excitation signals are regarded as sequence of impulses and the magnitudes of impulses are ignored, the following explanation will be made with reference to FIG. 3.

Figure 3:
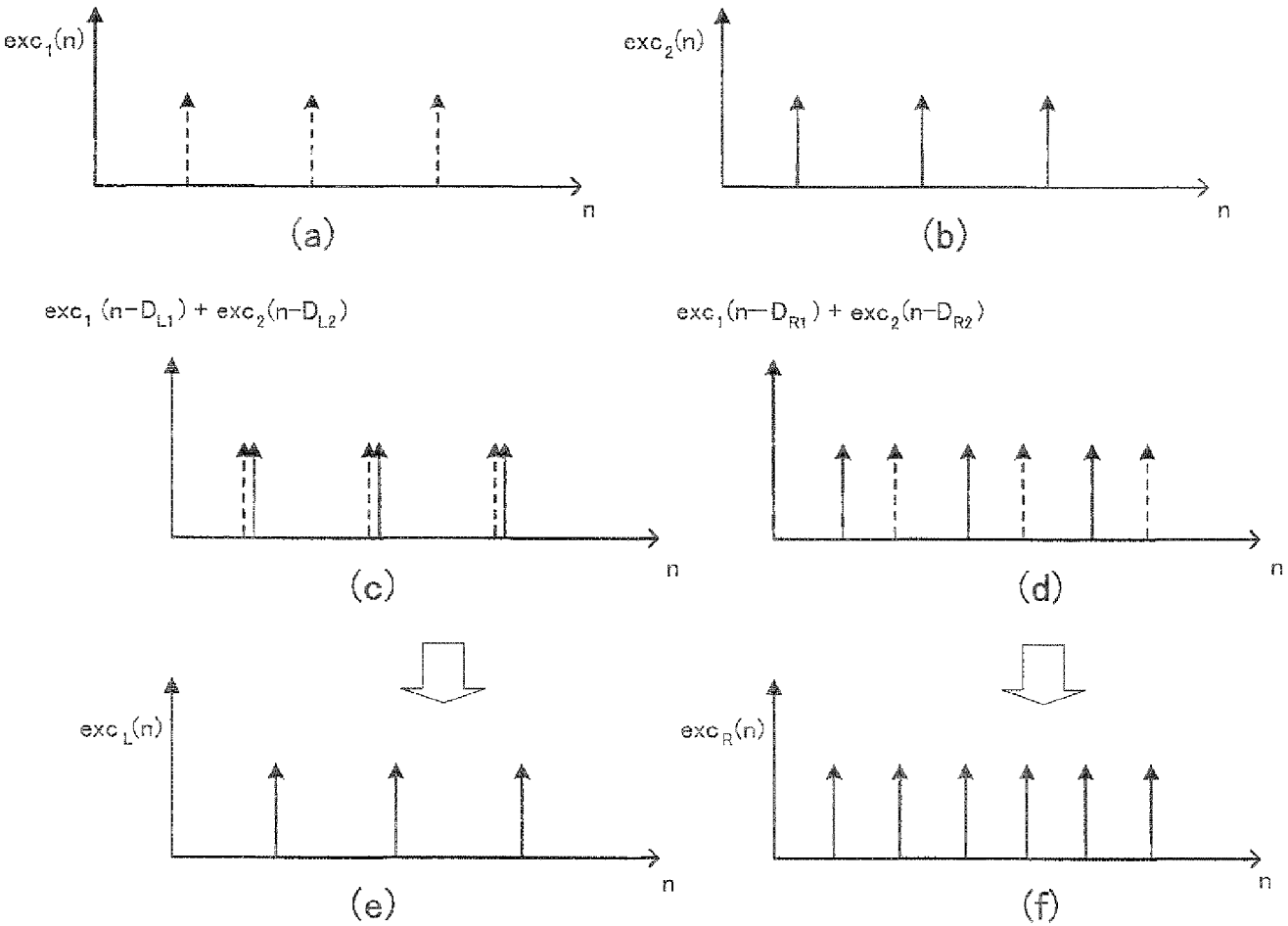
FIG. 3 is a diagram illustrating an example in which a pattern of $exc_L(n)$ is different from a pattern of $exc_R(n)$.

FIG. 3 is a diagram illustrating an example in which the pattern of $exc_L(n)$ is different from the pattern of $exc_R(n)$. The contents of FIG. 3 are as follows.

In FIG. 3, (a) shows a pattern of $exc_1(n)$.

In FIG. 3, (b) shows a pattern of $exc_2(n)$.

In FIG. 3, (c) shows a signal state in which $exc_1(n-D_{L1})$ and $exc_2(n-D_{L2})$ are mixed (wherein, in order make the description understandable, it is assumed that pulse positions where pulses of $exc_1(n-D_{L1})$ stand are the same as pulse positions where pulses of $exc_2(n-D_{L2})$ stand).

In FIG. 3, (d) shows a signal state in which $exc_1(n-D_{R1})$ and $exc_2(n-D_{R2})$ are mixed.

In FIG. 3, (e) shows a state of finally obtained left channel excitation signal $exc_L(n)$ (wherein, since the pulse positions where the pulses of $exc_1(n-D_{L1})$ stand are the same as the pulse positions where the pulses of $exc_2(n-D_{L2})$ stand, only the pulses of $exe_2(n-D_{L2})$ are shown).

In FIG. 3, (f) shows a state of finally obtained right channel excitation signal $exc_R(n)$.

From FIG. 3, it can be seen that, in the case where there are a plurality of sound sources, the pattern of $exc_L(n)$ ((e) of FIG. 3) may be completely different from the pattern of $exc_R(n)$ ((f) of FIG. 3). In this multiple-sound-source environment, even when the related art as disclosed in Non-Patent Literature 2 is applied to two input channel signals, an obtained time delay is invalid and causes a deterioration of the acoustic quality of a decoded signal. In this case, the peak tracking method disclosed in the present invention sets a time delay to zero or a time delay derived from a previous frame, thereby discarding an invalid time delay. The peak tracking method can be used to discard an invalid time delay, thereby preventing a deterioration of the acoustic quality. Here, whether to set the invalid time delay to zero or the time delay derived from the previous frame can be determined by the characteristics of the input signals. For example, in a case where the stereo feeling of the input signals does not significantly vary, the time delay is set to the time delay derived from the previous frame. Meanwhile, in a case where the stereo feeling of the input signals varies significantly, the time delay is set to zero.

There are cases where a plurality of sound sources may be regarded as a single sound source. It is possible to exemplify a case where different signal sources have the same time delay between a left channel signal and a right channel signal, a case where only one sound source of a plurality of sound sources is dominant, etc. In these cases, the peak tracking estimates the time delay by using the same principle as that in a case of a single-sound-source scenario.

Hereinafter, embodiments of the present invention will each be described. Those skilled in the art can modify and adapt the present invention without deviating from the scope of the present invention.

(Embodiment 1)

Figure 4:
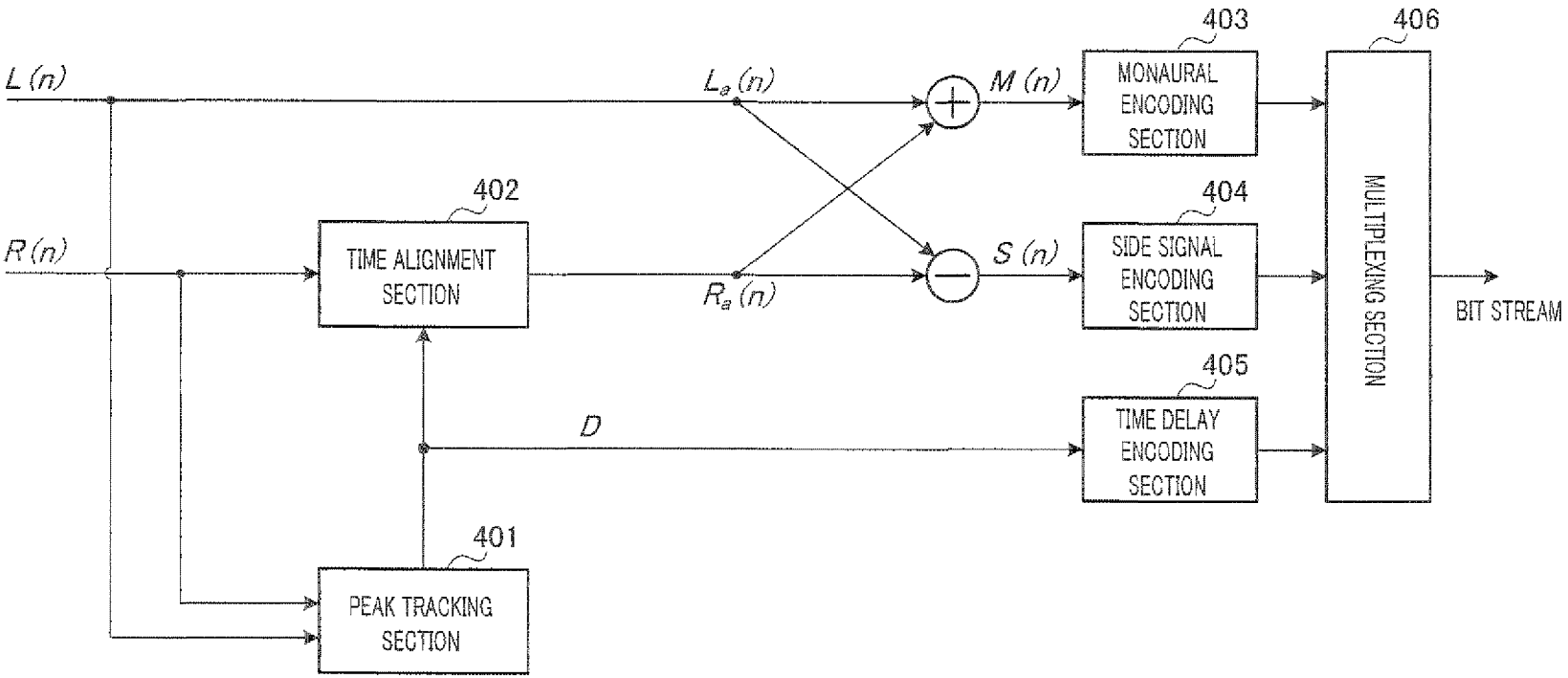
FIG. 4 is a block diagram illustrating a configuration of an encoding apparatus according to Embodiment 1 of the present invention.
Figure 5:
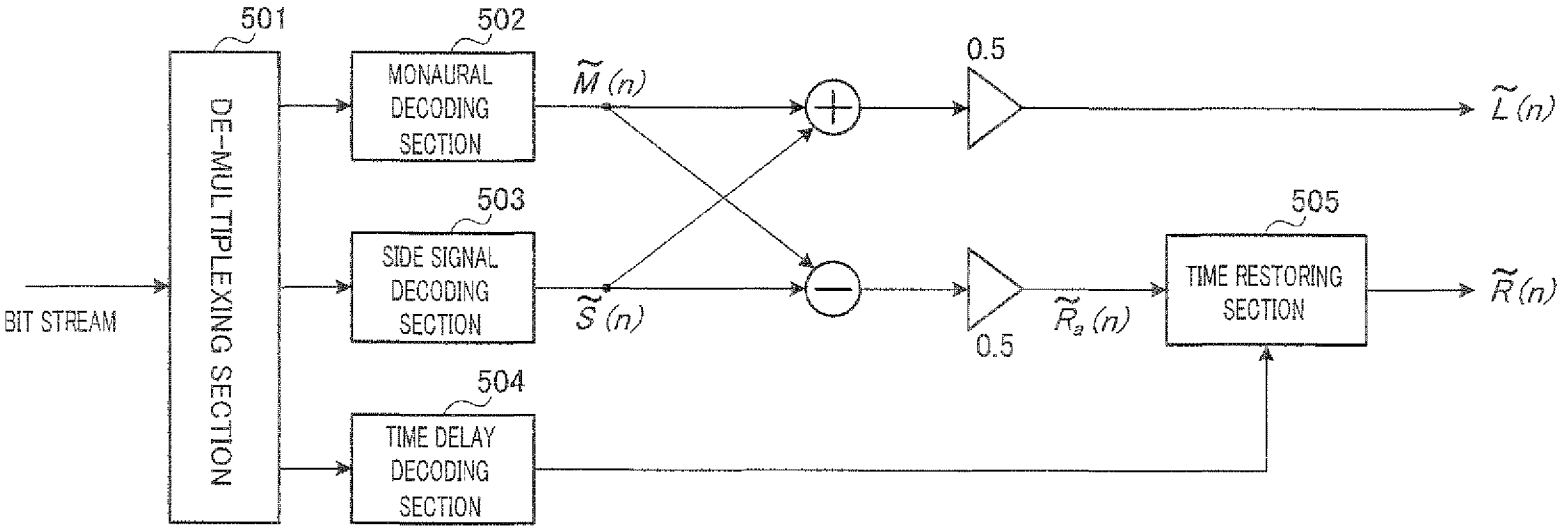
FIG. 5 is a block diagram illustrating a configuration of a decoding apparatus according to Embodiment 1 of the present invention.

FIG. 4 is a block diagram illustrating a configuration of an encoding apparatus which estimates a time delay by applying a peak tracking method. Also, FIG. 5 is a block diagram illustrating a configuration of a decoding apparatus which estimates a time delay by applying a peak tracking method.

In an encoding process shown in FIG. 4, peak tracking section 401 estimates time delay D corresponding to a time delay between left channel signal L(n) and right channel signal R(n) of a stereo signal by using the peak tracking method.

Time delay encoding section 405 encodes time delay D, and multiplexing section 406 multiplexes encoded parameters so as to form a bit stream.

Time alignment section 402 aligns right channel signal R(n) according to time delay D. Temporally aligned right channel signal is denoted by $R_a(n)$.

Down mix is performed on the temporally aligned signals according to equation 12.

Equation 12

$$\begin{cases} M(n) = L(n) + R_a(n) \\ S(n) = L(n) - R_a(n) \end{cases} \quad [12]$$

From equation 12, the temporally aligned signals can be generated according to equation 13.

Equation 13

$$\begin{cases} R_a(n) = 0.5^*(M(n) - S(n)) \\ L(n) = 0.5^*(M(n) + S(n)) \end{cases} \quad [13]$$

It is also possible to perform the down mix on the temporally aligned signals according to equation 14.

Equation 14

$$\begin{cases} M(n) = 0.5^*(L(n) + R_a(n)) \\ S(n) = 0.5^*(L(n) - R_a(n)) \end{cases} \quad [14]$$

From equation 14, the temporally aligned signals can be generated according to equation 15.

Equation 15

$$\begin{cases} R_a(n) = M(n) - S(n) \\ L(n) = M(n) + S(n) \end{cases} \quad [15]$$

Monaural encoding section 403 encodes a monaural signal M(n), and side signal encoding section 404 encodes a side signal S(n). Multiplexing section 406 multiplexes the encoded parameters input from both sides of monaural encoding section 403 and side signal encoding section 404 so as to form the bit stream.

In a decoding process shown in FIG. 5, de-multiplexing section 501 separates all of the encoded parameters and equalization parameters from the bit stream. Monaural decoding section 502 decodes the encoded parameters of the monaural signal so as to obtain a decoded monaural signal. Side signal decoding section 503 decodes the encoded parameters of the side signal so as to obtain a decoded side signal. Time delay decoding section 504 decodes the encoded time delay so as to obtain decoded time delay D.

The decoded monaural signal and the decoded side signal are used to generate a stereo signal according to equation 16.

Equation 16

$$\begin{cases} \tilde{R}_a(n) = 0.5^*\left(\tilde{M}(n) - \tilde{S}(n)\right) \\ \tilde{L}(n) = 0.5^*\left(\tilde{M}(n) + \tilde{S}(n)\right) \end{cases} \quad [16]$$

where:

$\tilde{M}(n)$ represents the decoded monaural signal;

$\tilde{S}(n)$ represents the decoded side signal; and $\tilde{R}_a(n)$ represents the input signal of time restoring section 505.

In a case where the down mix is performed according to the following equation 17, up mix is performed according to equation 18.

Equation 17

$$\begin{cases} M(n) = 0.5^*(L(n) + R_a(n)) \\ S(n) = 0.5^*(L(n) - R_a(n)) \end{cases} \quad [17]$$

Equation 18

$$\begin{cases} \tilde{R}_a(n) = \tilde{M}(n) - \tilde{S}(n) \\ \tilde{L}(n) = \tilde{M}(n) + \tilde{S}(n) \end{cases} \quad [18]$$

Time restoring section 505 aligns the phase of the input signal of time restoring section 505 according to decoded time delay D so as to generate an output signal of time restoring section 505.

Figure 6:
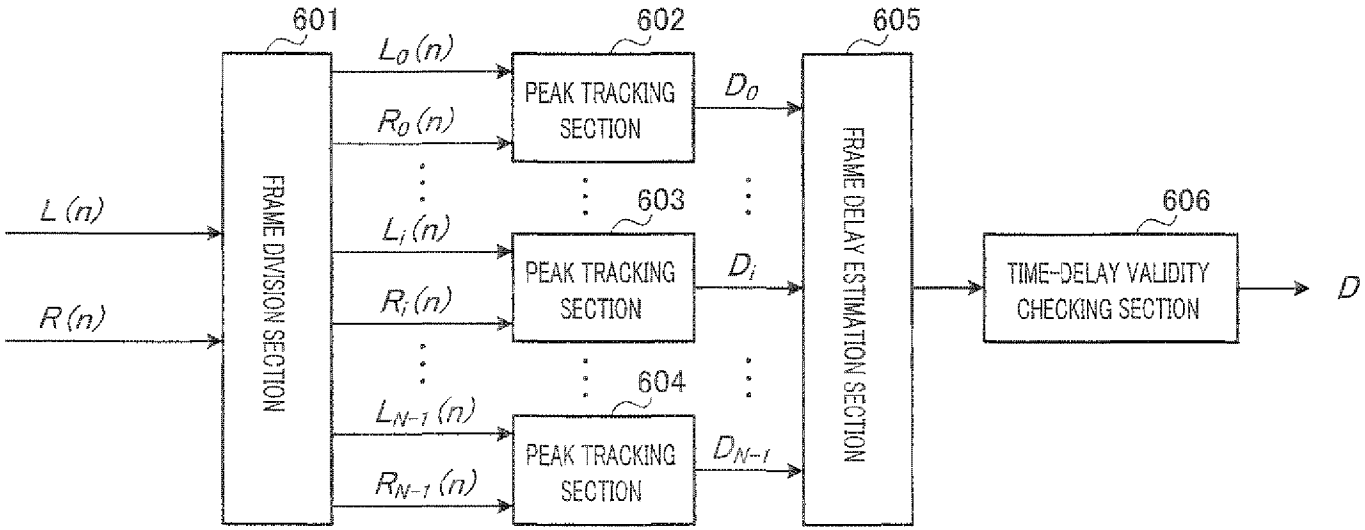
FIG. 6 is a block diagram illustrating a configuration of a peak tracking section according to Embodiment 1 of the present invention.

FIG. 6 is a block diagram illustrating a configuration of peak tracking section 401 and shows the principle of the peak tracking method. Frame division section 601 divides every input frame of input left channel signal L(n) and right channel signal R(n) into a plurality of sub frames. Here, the number of sub frames is set to N.

Peak tracking sections 602, 603, and 604 apply the peak tracking to each sub frame so as to obtain sub-frame time delays $D_0$ to $D_{N-1}$. Frame delay estimation section 605 estimates frame time delay D by using sub-frame time delays $D_0$ to $D_{N-1}$.

One of methods of estimating the frame time delay is to compute an average of the time delays of the sub frames as follows.

Equation 19

$$D = \frac{\sum_{i=0}^{N-1} D_i}{N} \quad [19]$$

As another method, a method of making the frame time delay equal to a sub-frame time delay whose appearance frequency is the maximum is exemplified. For example, in a case where, among sub-frame time delays $D_0$ to $D_{N-1}$, only one time delay is 2 and all the other time delays are 0, 0 is selected as the frame time delay (D=0). Also, as expressed by the following equation, D may be a median value of $D_i$.

$$D=\text{median}\{D_i\} \quad \text{Equation 20}$$

However, the frame time delay estimation method is not limited to those two examples.

Next, time-delay validity checking section 606 checks on the validity of frame time delay D.

Time-delay validity checking section 606 compares time delay D with every sub-frame time delay, and counts the number of sub frames in each of which the difference between time delay D and the sub-frame delay is out of a predetermined range. In a case where the number of sub frames out of the predetermined range exceeds threshold value M, time-delay validity checking section 606 regards time delay D as invalid. Here, threshold value M is defined as a predetermined value or a value adaptively computed according to the signal characteristics. In a case where the time delay is valid, time-delay validity checking section 606 outputs the time delay computed in a current frame. Meanwhile, in a case where the time delay is not valid (invalid), time-delay validity checking section 606 outputs the time delay of the previous frame. Also, in the case where the time delay is invalid, instead of the time delay computed in the current frame, zero (in this case, it is regarded that there is no phase difference between left channel signal L(n) and right channel signal R(n)) or an average of time delays of some previous frames may be used. These values may also be alternately output for every frame.

Figure 7:
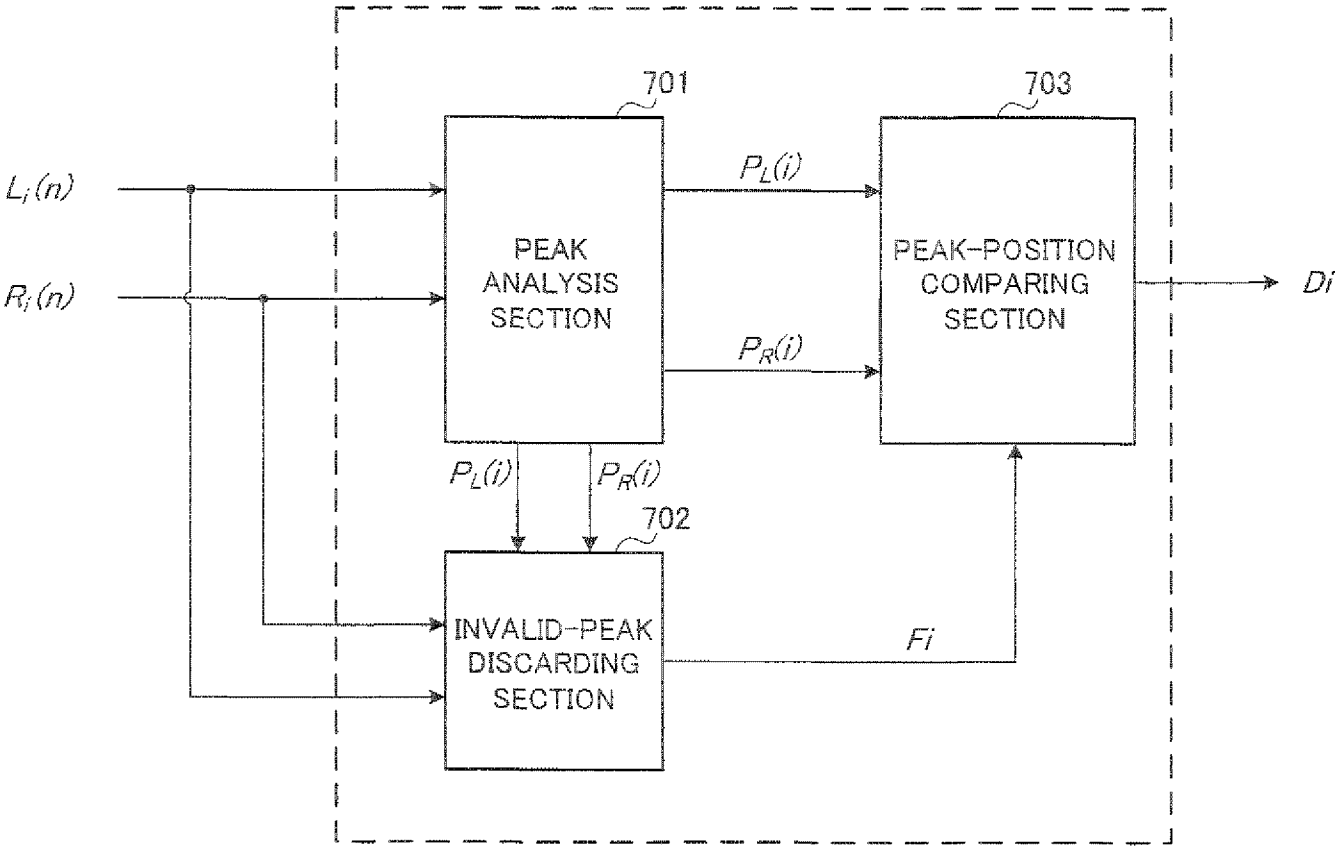
FIG. 7 is a block diagram illustrating a configuration of another peak tracking section according to Embodiment 1 of the present invention.

FIG. 7 is a block diagram illustrating a configuration of peak tracking sections 602, 603, and 604, and shows detailed steps of the peak tracking applied to each sub frame. As an example, a case of a sub frame i will be described.

Input signal $L_i(n)$ of sub frame i is an input signal of an i-th sub frame of L(n), and input signal $R_i(n)$ of sub frame i is an input signal of the i-th sub frame of R(n). Further, output signal $D_i$ is the sub-frame time delay of the i-th sub frame.

Peak analysis section 701 obtains the positions of peaks of inputs $L_i(n)$ and $R_i(n)$ of the sub frame. Invalid-peak discarding section 702 outputs indicator $F_i$ indicating whether the peaks are valid. In a case where the peaks are valid, peak-position comparing section 703 compares the positions of the peaks of two channels, and outputs sub-frame time delay $D_i$.

Figure 8:
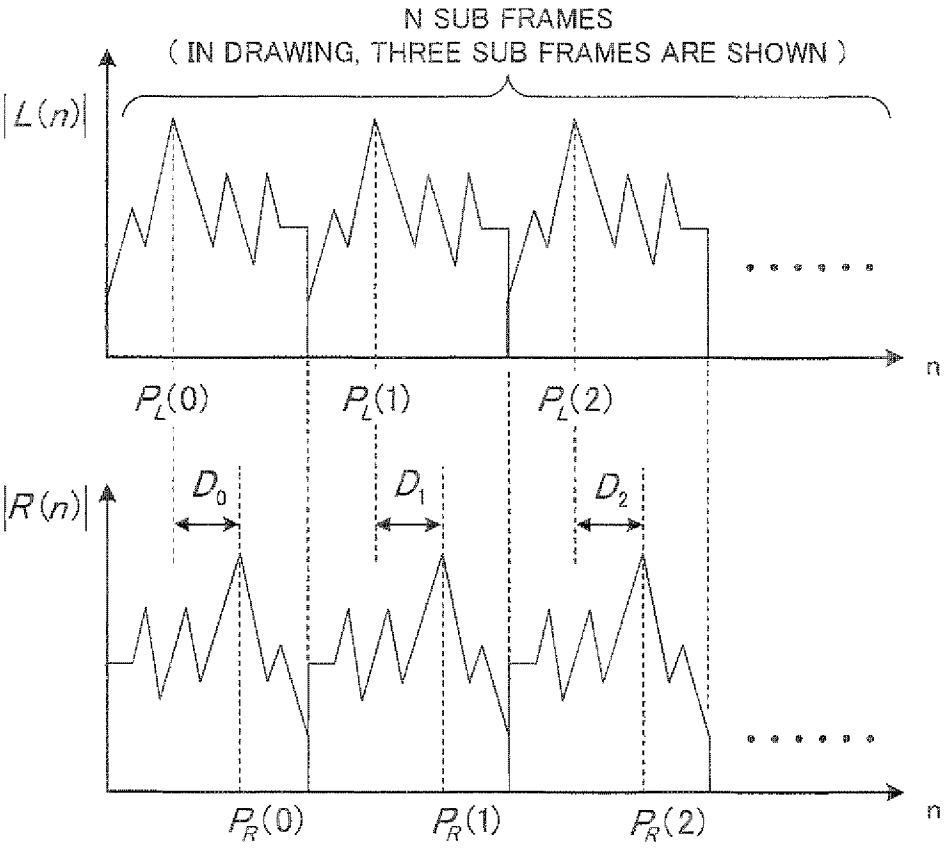
FIG. 8 is a diagram illustrating a process of the peak tracking section according to Embodiment 1 of the present invention in detail.

FIG. 8 is a view explaining details of a process of peak analysis section 701.

First, peak tracking sections 602, 603, and 604 compute the absolute values of L(n) and R(n) before the process.

Also, peak tracking sections 602, 603, and 604 divides absolute values |L(n)| and |R(n)| into N sub frames. In FIG. 8, three sub frames are shown as examples. Peak tracking sections 602, 603, and 604 find the positions of the maximum values in each sub frame ($P_L(\mathbf{0})$ to $P_L(N-1)$ and $P_R(\mathbf{0})$ to $P_R(N-1)$). Next, peak tracking sections 602, 603, and 604 estimate sub-frame time delays $D_0$ to $D_{N-1}$ by differences in the positions of the peak values. If sub frame i is taken as an example, time delay $D_i$ is estimated as follows.

$$D_i=P_R(i)-P_L(i) \quad \text{Equation 21}$$

Figure 9:
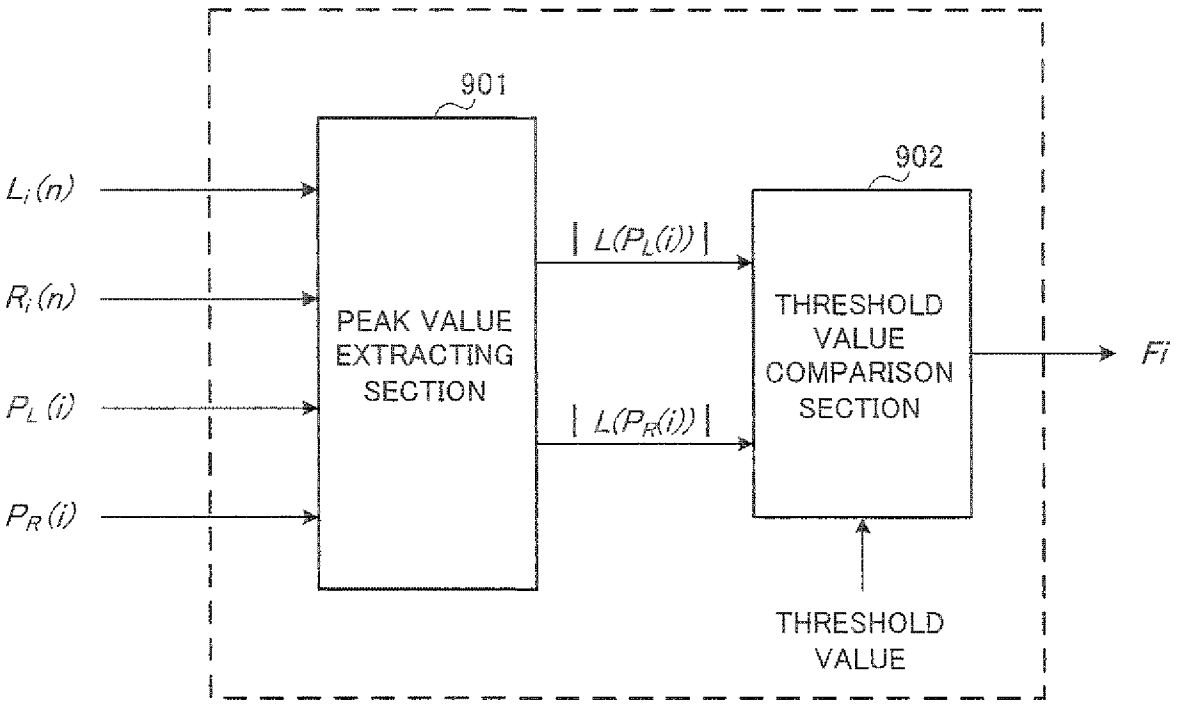
FIG. 9 is a block diagram illustrating a configuration of an invalid-peak discarding section according to Embodiment 1 of the present invention.

FIG. 9 is a block diagram illustrating a configuration of invalid-peak discarding section 702.

In some sub frames, any excitation impulses may not exist. In this case, peaks specified in those sub frames do not correspond to excitation impulses. In this case, the time delays derived from the sub frames are not appropriate time delays.

Invalid-peak discarding section 702 prevents those time delays from being used for estimating the frame time delay.

One of methods of checking whether a peak of a sub frame corresponds to an excitation impulse is to compare the value of the peak with a predetermined threshold value. This threshold value can be determined from the peak value of the previous frame or the peak value of another sub frame of the same frame.

In FIG. 9, peak value extracting section 901 obtains peak values $|L(P_L(i))|$ and $|R(P_R(i))|$ by using inputs $L_i(n)$ and $R_i(n)$ and peak positions $P_L(i)$ and $P_R(i)$ of the sub frame. Next, threshold value comparison section 902 compares those two peak values with the predetermined threshold value. In a case where the peak values are larger than the threshold value, output flag $F_i$ output from threshold value comparison section 902 becomes 1 (indicating that the peaks are valid). In a case where the peak values are smaller than the threshold value, output flag $F_i$ output from threshold value comparison section 902 becomes 0 (indicating that the peaks are invalid). In this case, sub-frame time delay $D_i$ is not used for estimating the frame time delay.

Figure 10:
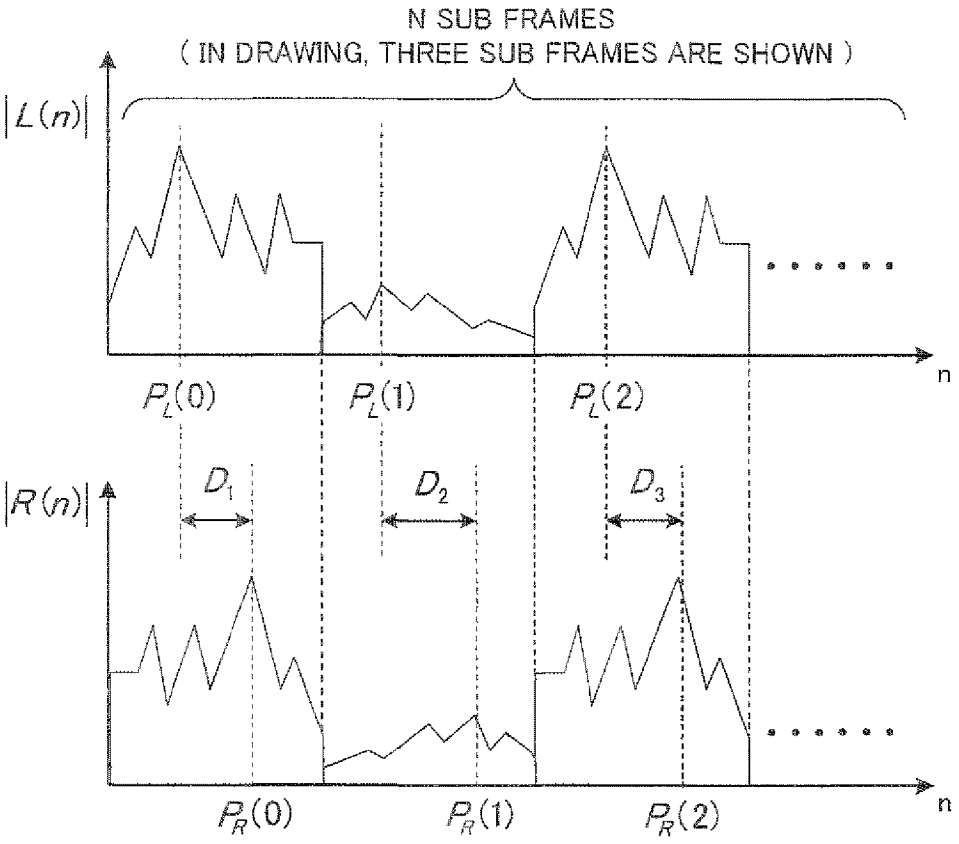
FIG. 10 is a diagram for explaining an operation of the invalid-peak discarding section according to Embodiment 1 of the present invention.

FIG. 10 is a diagram for explaining an operation of invalid-peak discarding section 702.

In FIG. 10, since any excitation impulses do not exist in the second sub frame, the peak values of the second sub frame (in which sub-frame index is 1) are much smaller than the peak values of the other sub frames. Therefore, invalid-peak discarding section 702 discards the sub-frame time delay of the second sub frame.

According to Embodiment 1, a stereo input signal frame is divided into a plurality of sub frames and the positions of the peaks of each sub frame are obtained. Further, the positions of the peaks are compared so as to obtain estimated sub-frame time delays. Furthermore, a finally estimated time delay is obtained by using the plurality of sub-frame time delays. This peak tracking is a signal-dependent method using the waveform characteristic of the input signal, and is an effective and accurate time delay estimation method. Therefore, according to Embodiment 1, since the peak tracking uses only peak information, it is possible to significantly reduce the amount of computational complexity, as compared to a time estimation method using a cross correlation according to the related art, or a time estimation method using a time-to-frequency transform according to the related art.

Also, according to Embodiment 1, the process of discarding invalid peaks is added. Discarding invalid peaks is performed by comparing the peak values with the predetermined threshold value such that the peaks obtained in the sub frames necessarily correspond to excitation impulses. When a peak value is smaller than the predetermined value, the peak is discarded. Since invalid peaks are discarded, only peaks corresponding to the excitation impulses are used for estimating the frame time delay. Therefore, it is possible to obtain a more accurate time delay.

In Embodiment 1, the right channel signal is time-aligned. However, Embodiment 1 is not limited thereto. The left channel signal may be time-aligned. Also, as variations of Embodiment 1, the following variations 1 to 6 can be considered.

(Variation 1)

One of the left channel signal and the right channel signal can be aligned according to the sign of the time delay.

Figure 11:
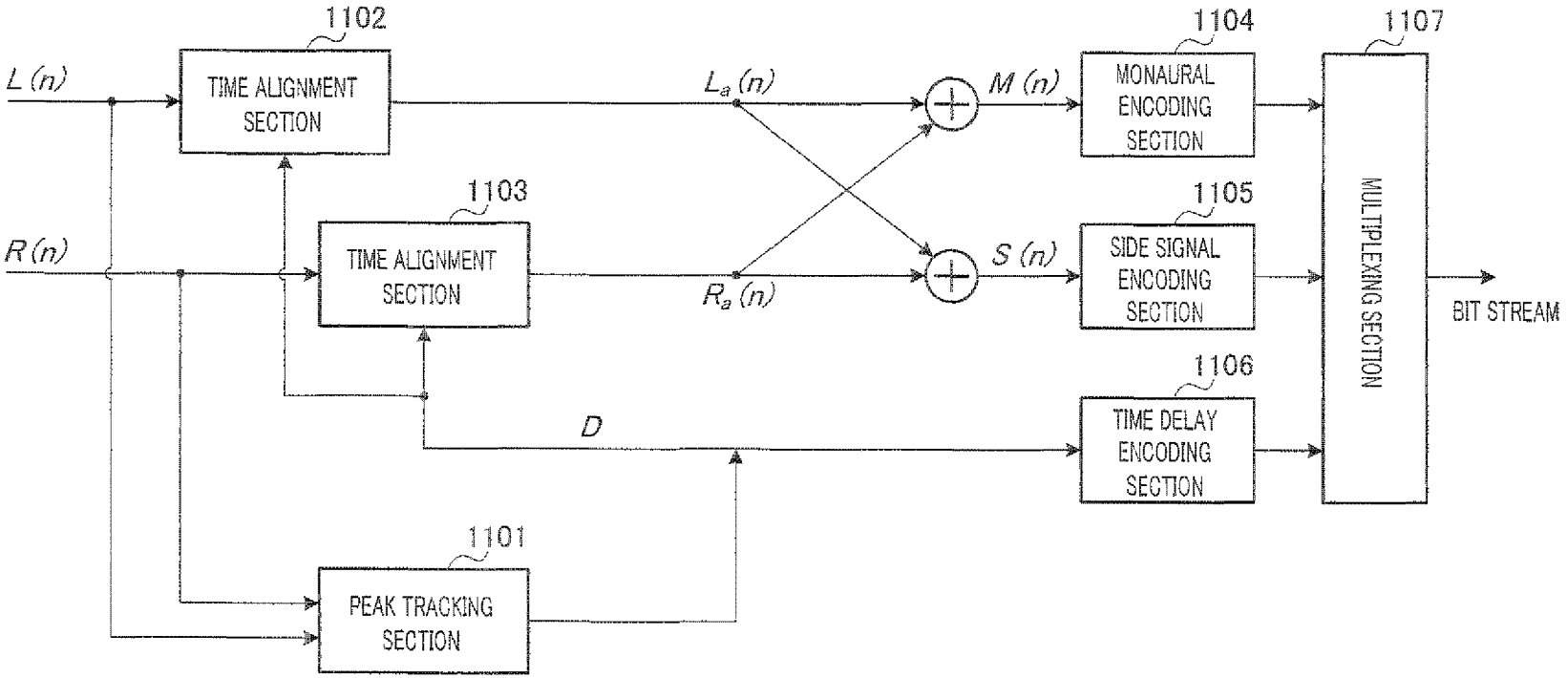
FIG. 11 is a block diagram illustrating a variation of the configuration of the encoding apparatus according to Embodiment 1 of the present invention.
Figure 12:
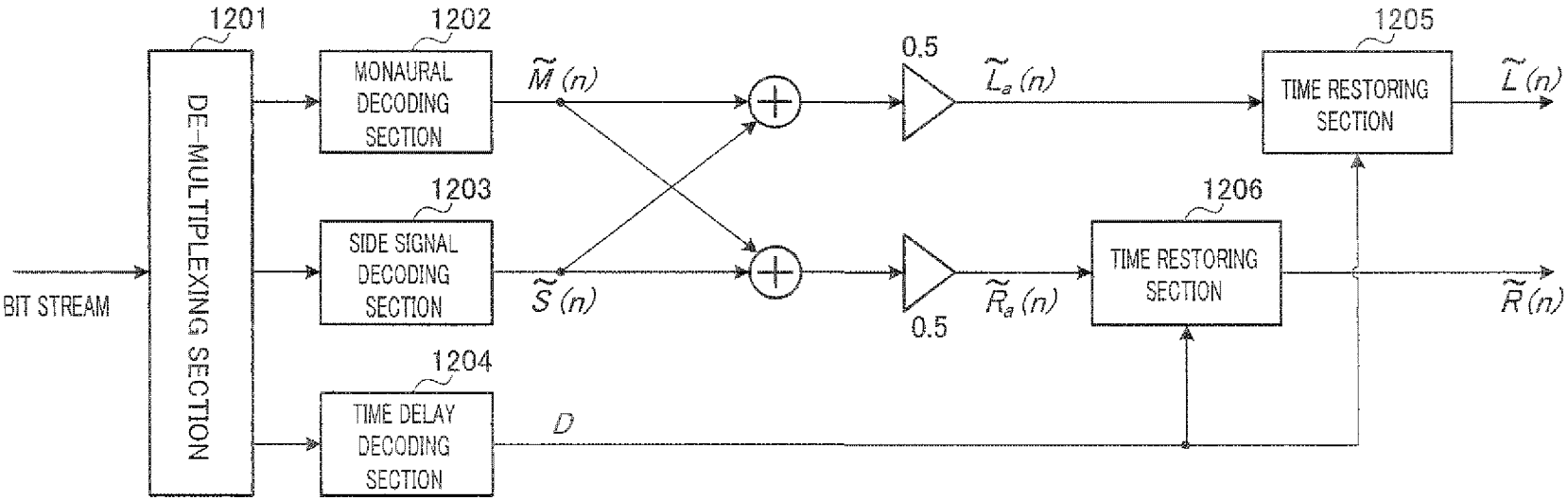
FIG. 12 is a block diagram illustrating a variation of the configuration of the decoding apparatus according to Embodiment 1 of the present invention.

FIG. 11 is a block diagram illustrating Variation 1 of the configuration of the encoding apparatus of Embodiment 1, and FIG. 12 is a block diagram illustrating Variation 1 of the configuration of the decoding apparatus of Embodiment 1. This codec has a configuration different from the encoding apparatus (FIG. 4) and the decoding apparatus (FIG. 5) proposed in Embodiment 1.

In the encoding apparatus shown in FIG. 11, in a case where a time delay computed by peak tracking section 1101 is positive, that is, right channel signal R(n) is later than left channel signal L(n), time alignment section 1103 aligns the phase of right channel signal R(n). In a case where a time delay computed by peak tracking section 1101 is negative, that is, left channel signal L(n) is later than right channel signal R(n), time alignment section 1102 aligns the phase of L(n). Since time alignment section 1103 performs the same process as time alignment section 402, a description thereof is omitted. Also, since monaural encoding section 1104 performs the same process as monaural encoding section 403, a description thereof is omitted. Further, since side signal encoding section 1105 performs the same process as side signal encoding section 404, a description thereof is omitted. Furthermore, since time delay encoding section 1106 performs the same process as time delay encoding section 405, a description thereof is omitted. Moreover, since multiplexing section 1107 performs the same process as multiplexing section 406, a description thereof is omitted.

In the decoding apparatus shown in FIG. 12, in a case where the decoded time delay is positive, time restoring section 1206 aligns the phase of right channel signal R(n) in a reverse direction. In a case where the decoded time delay is negative, time restoring section 1205 aligns the phase of left channel signal L(n) in the reverse direction. Since de-multiplexing section 1201 performs the same process as the de-multiplexing section 501, a description thereof is omitted. Further, since monaural decoding section 1202 performs the same process as monaural decoding section 502, a description thereof is omitted. Furthermore, since side signal decoding section 1203 performs the same process as side signal decoding section 503, a description thereof is omitted. Moreover, since time delay decoding section 1204 performs the same process as time delay decoding section 504, a description thereof is omitted.

Effects of Variation 1 are as follow. First, it is possible to express the stereo signal as follows.

Equation 22

$$\begin{cases} L(n) = A_L * s_1(n - D_L) + N_L(n) \\ R(n) = A_R * s_1(n - D_R) + N_R(n) \end{cases} \quad [22]$$

where:

$A_L$ represents an attenuation factor until $s_1(n)$ reaches a left channel sound recording apparatus;

$A_R$ represents an attenuation factor until $s_1(n)$ reaches a right channel sound recording apparatus;

$D_L$ represents an arrival time until $s_1(n)$ reaches the left channel sound recording apparatus;

$D_R$ represents an arrival time until $s_1(n)$ reaches the right channel sound recording apparatus;

$N_L$ represents background noise in the left channel sound recording apparatus; and $N_R$ represents background noise in the right channel sound recording apparatus.

Here, in the relationship between $D_L$ and $D_R$, there are three cases of $D_L>D_R$, $D_L=D_R$, and $D_L<D_R$.

In the case of $D_L=D_R$, a time delay between the two channel signals is 0.

In the case of $D_L>D_R$, since left channel signal L(n) is later than right channel signal R(n), left channel signal L(n) is aligned.

In the case of $D_L<D_R$, since right channel signal R(n) is later than left channel signal L(n), right channel signal R(n) is aligned.

Therefore, if Variation 1 is applied, it is possible to flexibly align the time delays of the right channel signal and the left channel signal according to the time delays of the input signals.

(Variation 2)

Before the peak tracking section computes time delay D, a linear prediction process is performed on left channel signal L(n) and right channel signal R(n).

Figure 13:
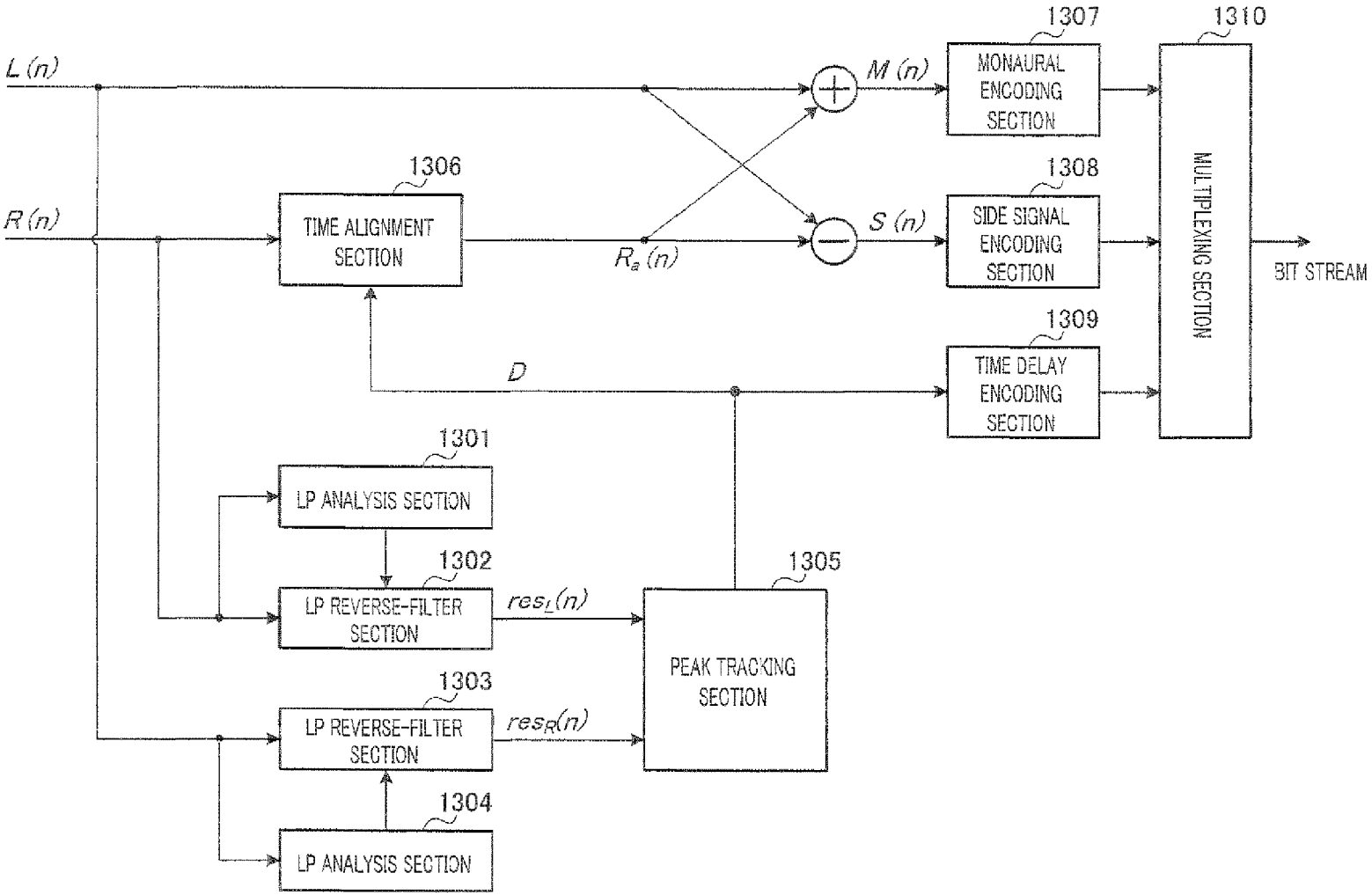
FIG. 13 is a block diagram illustrating another variation of the configuration of the encoding apparatus according to Embodiment 1 of the present invention.

FIG. 13 is a block diagram illustrating Variation 2 of the configuration of the encoding apparatus of Embodiment 1.

In the encoding apparatus shown in FIG. 13, linear prediction (LP) analysis sections 1301 and 1303 perform the linear prediction process on left channel signal L(n) and right channel signal R(n), respectively. Peak tracking section 1305 estimates the time delay by using residual signals $res_L(n)$ and $res_R(n)$ obtained by linear prediction (LP) reverse-filter sections 1302 and 1303.

Since peak tracking section 1305 performs the same process as peak tracking section 401, a description thereof is omitted. Also, since time alignment section 1306 performs the same process as time alignment section 402, a description thereof is omitted. Further, since monaural encoding section 1307 performs the same process as monaural encoding section 403, a description thereof is omitted. Furthermore, since side signal encoding section 1308 performs the same process as side signal encoding section 404, a description thereof is omitted. Moreover, since time delay encoding section 1309 performs the same process as time delay encoding section 405, a description thereof is omitted. Moreover, since multiplexing section 1310 performs the same process as multiplexing section 406, a description thereof is omitted. As for a decoding apparatus, since it is identical to the decoding apparatus shown in FIG. 5, a description thereof is omitted.

According to this configuration, a linear prediction residual is derived from the input signals by using a linear prediction coefficient (LP coefficient), and a correlation between samples of the signal is eliminated by the linear prediction such that a large change in the amplitude is obtained in the vicinity of a timing of large excitation. Therefore, it is possible to well detect the position of a peak by the linear prediction residual.

(Variation 3)

Before the peak tracking section estimates the time delay, low-frequency pass filters process left channel signal L(n) and right channel signal R(n).

Figure 14:
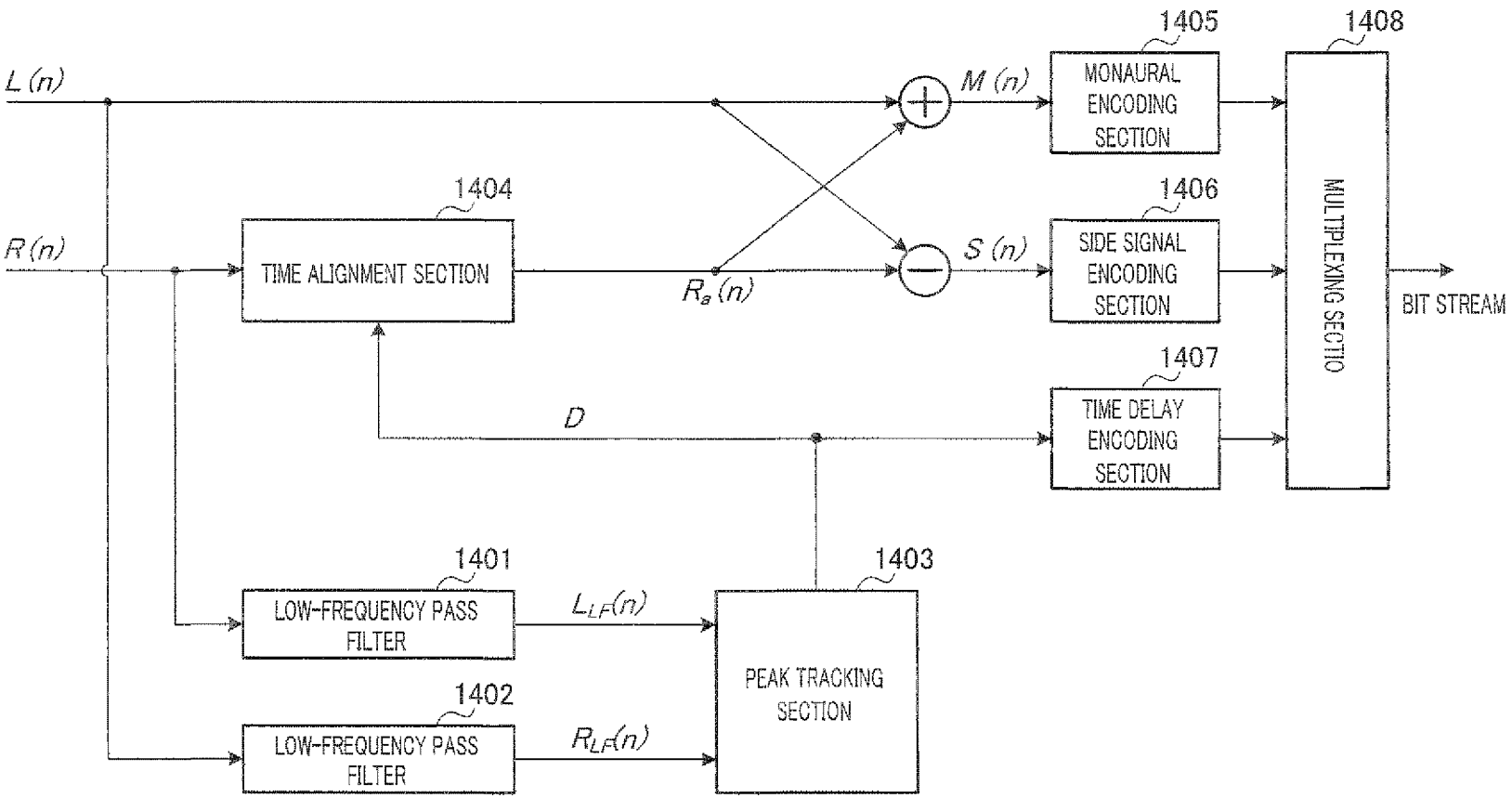
FIG. 14 is a block diagram illustrating a further variation of the configuration of the encoding apparatus according to Embodiment 1 of the present invention.

FIG. 14 is a block diagram illustrating Variation 3 of the configuration of the encoding apparatus of Embodiment 1.

In the encoding apparatus shown in FIG. 14, left channel signal L(n) and right channel signal R(n) are processed by low-frequency pass filters 1401 and 1402. Peak tracking section 1403 estimates the time delay by using output signal $L_{LF}(n)$ of low-frequency pass filter for the left channel signal and output signal $R_{LF}(n)$ of low-frequency pass filter for the right channel signal Since peak tracking section 1403 performs the same process as peak tracking section 401, a description thereof is omitted. Also, since time alignment section 1404 performs the same process as time alignment section 402, a description thereof is omitted. Further, since monaural encoding section 1405 performs the same process as monaural encoding section 403, a description thereof is omitted. Furthermore, since side signal encoding section 1406 performs the same process as side signal encoding section 404, a description thereof is omitted. Moreover, since time delay encoding section 1407 performs the same process as time delay encoding section 405, a description thereof is omitted. Moreover, since multiplexing section 1408 performs the same process as multiplexing section 406, a description thereof is omitted. As for a decoding apparatus, since it is identical to the decoding apparatus shown in FIG. 5, a description thereof is omitted.

According to this configuration, it is possible to well detect the position of a peak in a low-frequency signal.

(Variation 4)

The number of sub frames is variable for each frame. The number of sub frames is determined according to a pitch period obtained from the monaural encoding section.

Figure 15:
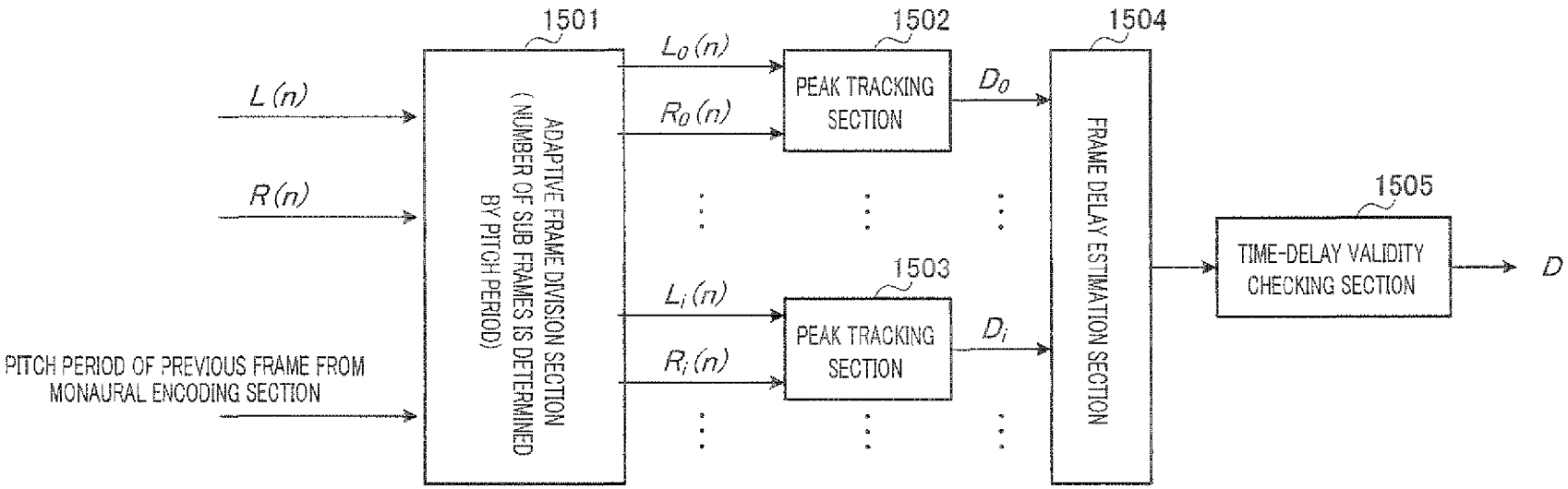
FIG. 15 is a block diagram illustrating a variation of the configuration of the peak tracking section according to Embodiment 1 of the present invention.

FIG. 15 is a block diagram illustrating Variation 1 of the configuration of the peak tracking section of Embodiment 1.

In an encoding apparatus shown in FIG. 15, adaptive frame division section 1501 divides left channel signal L(n) and right channel signal R(n) into a variable number of sub frames. The number of sub frames is determined by the pitch period of the previous frame from the monaural encoding section. Since peak tracking sections 1502 and 1503 perform the same process as peak tracking sections 602, 603, and 604, a description thereof is omitted. Also, since frame delay estimation section 1504 performs the same process as frame delay estimation section 605, a description thereof is omitted. Further, time-delay validity checking section 1505 performs the same process as time-delay validity checking section 606, a description thereof is omitted.

Therefore, since the pitch period obtained from the monaural encoding section can be used to more accurately detect the positions of the pitches from the sub frames synchronized with the pitch period, it is possible to well estimate the time delay.

(Variation 5)

The boundaries of the sub frames are variable for each frame. The boundaries of the sub frames are defined according to the pitch period obtained from the monaural encoding section.

Figure 16:
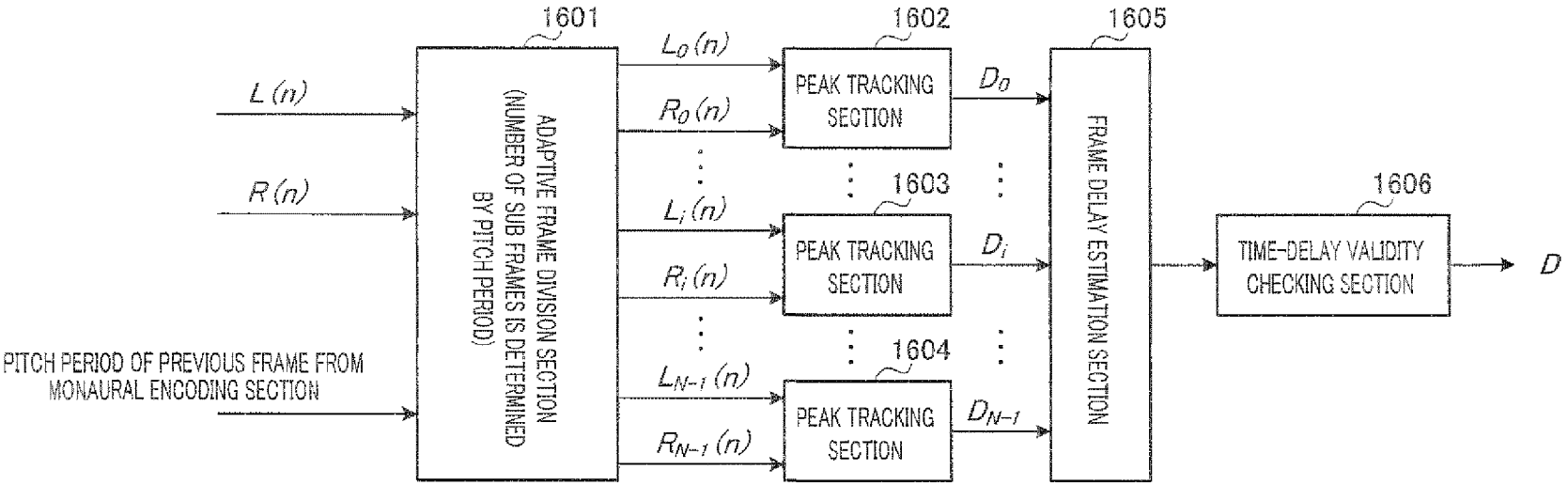
FIG. 16 is a block diagram illustrating another variation of the configuration of the peak tracking section according to Embodiment 1 of the present invention.

FIG. 16 is a block diagram illustrating Variation 2 of the configuration of the peak tracking section of Embodiment 1.

In the peak tracking section shown in FIG. 16, adaptive frame division section 1601 divides left channel signal L(n) and right channel signal R(n) into a plurality of sub frames. The number of sub frames is defined by the pitch period of the previous frame from the monaural encoding section. Since peak tracking sections 1602, 1603, and 1604 perform the same process as peak tracking sections 602, 603, and 604, a description thereof is omitted. Further, since frame delay estimation section 1605 performs the same process as frame delay estimation section 605, a description thereof is omitted. Furthermore, time-delay validity checking section 1606 performs the same process as time-delay validity checking section 606, a description thereof is omitted.

Therefore, since the pitch period obtained from the monaural encoding section can be used to more accurately detect the positions of the pitches from the sub frames synchronized with the pitch period, it is possible to well estimate the time delay.

(Variation 6)

A plurality of sub-frame lengths are defined, and the peak tracking is performed in parallel in each sub-frame length setting. Time delay D is determined by every time delay D obtained from the peak tracking in each sub-frame length.

Therefore, it is possible to better estimate the time delay by using the plurality of sub-frame lengths.

(Embodiment 2)

The peak tracking method can also be used for the purpose of checking on the validity of the time delay derived from another time delay estimation method (for example, a cross correlation method).

Figure 17:
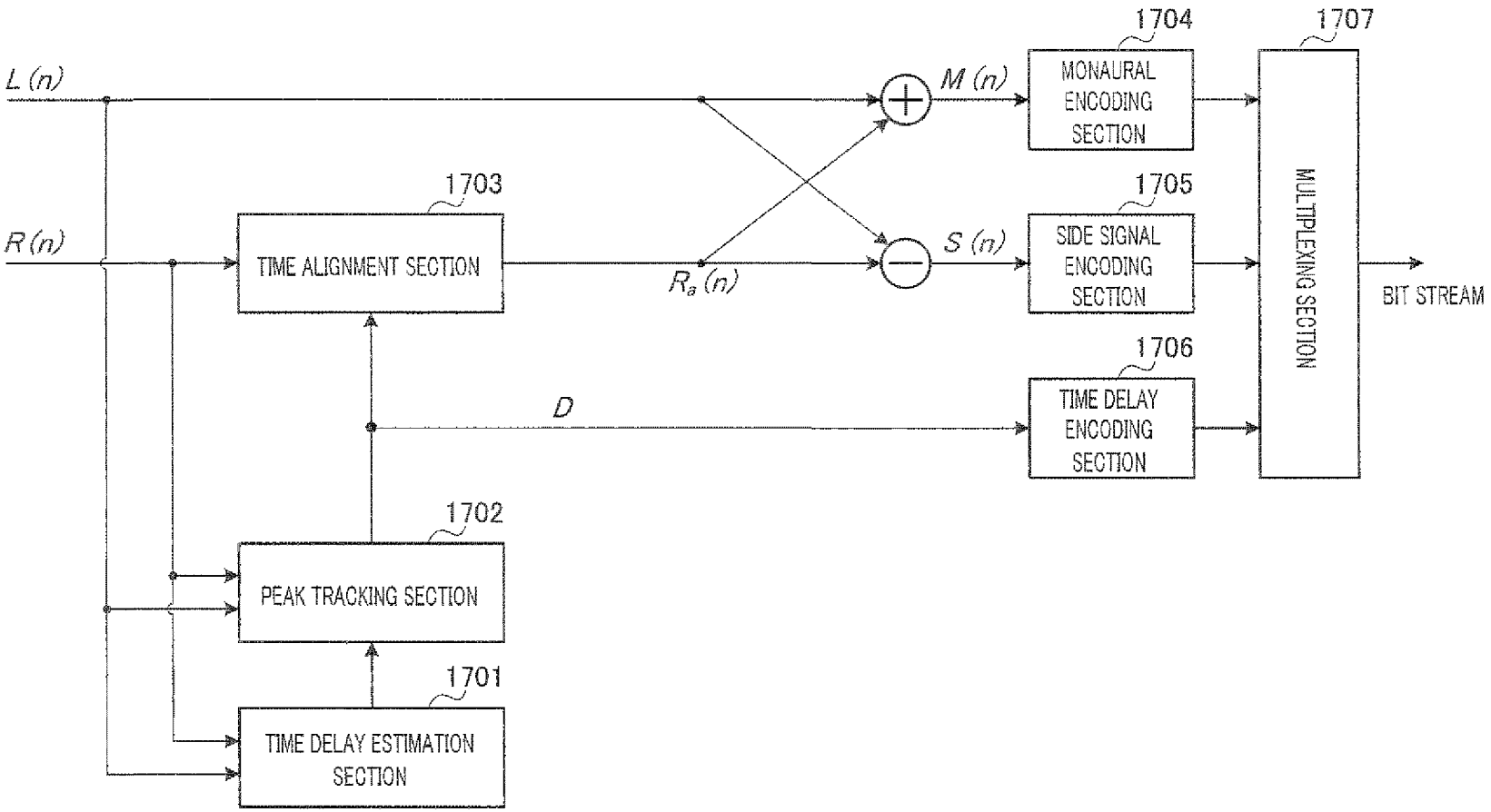
FIG. 17 is a block diagram illustrating a configuration of an encoding apparatus according to Embodiment 2 of the present invention.

FIG. 17 is a block diagram illustrating a configuration of an encoding apparatus according to Embodiment 2 of the present invention, and most of this encoding apparatus is identical to the encoding apparatus of Embodiment 1 shown in FIG. 4. In FIG. 17, time delay estimation section 1701 estimates the time delay by an encoding method other than the encoding method which estimates the time delay by applying the peak tracking method. Also, peak tracking section 1702 checks on the validity of the time delay computed in time delay estimation section 1701.

Figure 18:
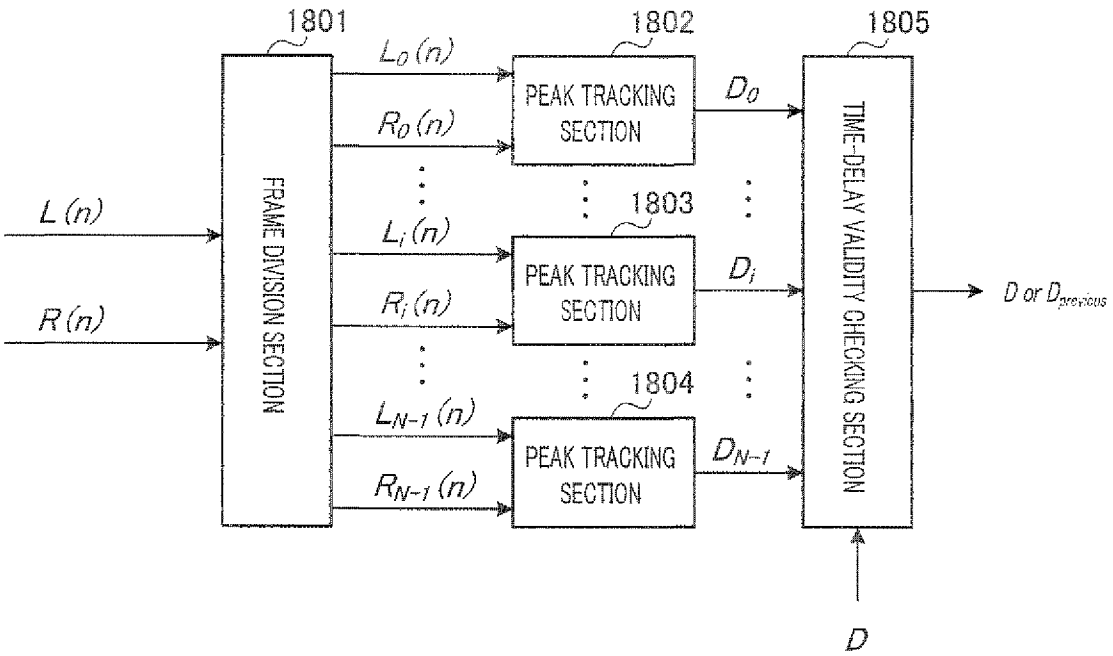
FIG. 18 is a block diagram illustrating a configuration of a peak tracking section according to Embodiment 2 of the present invention.

FIG. 18 is a block diagram illustrating a configuration of peak tracking section 1702 when peak tracking section 1702 is applied for checking on the validity of the time delay computed by time delay estimation section 1701.

First, frame division section 1801 divides the input frame of left channel signal L(n) and right channel signal R(n) into a plurality of sub frames. The number of sub frames is denoted by N.

Next, peak tracking sections 1802, 1803, and 1804 obtain sub-frame time delays $D_0$ to $D_{N-1}$ of the N sub frames. Time-delay validity checking section 1805 checks on the validity of frame time delay D computed by time delay estimation section 1701 by using sub-frame time delays $D_0$ to $D_{N-1}$. Since time alignment section 1703 performs the same process as time alignment section 402, a description thereof is omitted. Also, since monaural encoding section 1704 performs the same process as monaural encoding section 403, a description thereof is omitted. Further, since side signal encoding section 1705 performs the same process as side signal encoding section 404, a description thereof is omitted. Furthermore, since time delay encoding section 1706 performs the same process as time delay encoding section 405, a description thereof is omitted. Moreover, since multiplexing section 1707 performs the same process as multiplexing section 406, a description thereof is omitted.

Time-delay validity checking section 1805 compares time delay D computed by time delay estimation section 1701 with each of sub-frame time delays $D_0$ to $D_{N-1}$, and counts the number of sub frames in each of which the difference between time delay D and the sub-frame delay is out of a predetermined range. In a case where the number of sub frames out of the predetermined range exceeds threshold value M, time-delay validity checking section 1805 regards time delay D computed by time delay estimation section 1701 as invalid. Here, threshold value M is defined as a predetermined value or a value adaptively computed according to the signal characteristics.

In a case where it is determined that time delay D is invalid, time-delay validity checking section 1805 outputs the time delay of the previous frame. Meanwhile, in a case where it is determined that time delay D is valid, time-delay validity checking section 1805 outputs time delay D computed by time delay estimation section 1701. Also, in the case where it is determined that the time delay is invalid, instead of the time delay computed in the current frame, zero (in this case, it is regarded that there is no phase difference between left channel signal L(n) and right channel signal R(n)) or an average of time delays of some previous frames may be used. These values may also be alternately output for every frame.

<Variation of Embodiment 2>

In Variation of Embodiment 2, before division into a plurality of sub frames, L(n) and R(n) are aligned according to derived time delay D.

Figure 19:
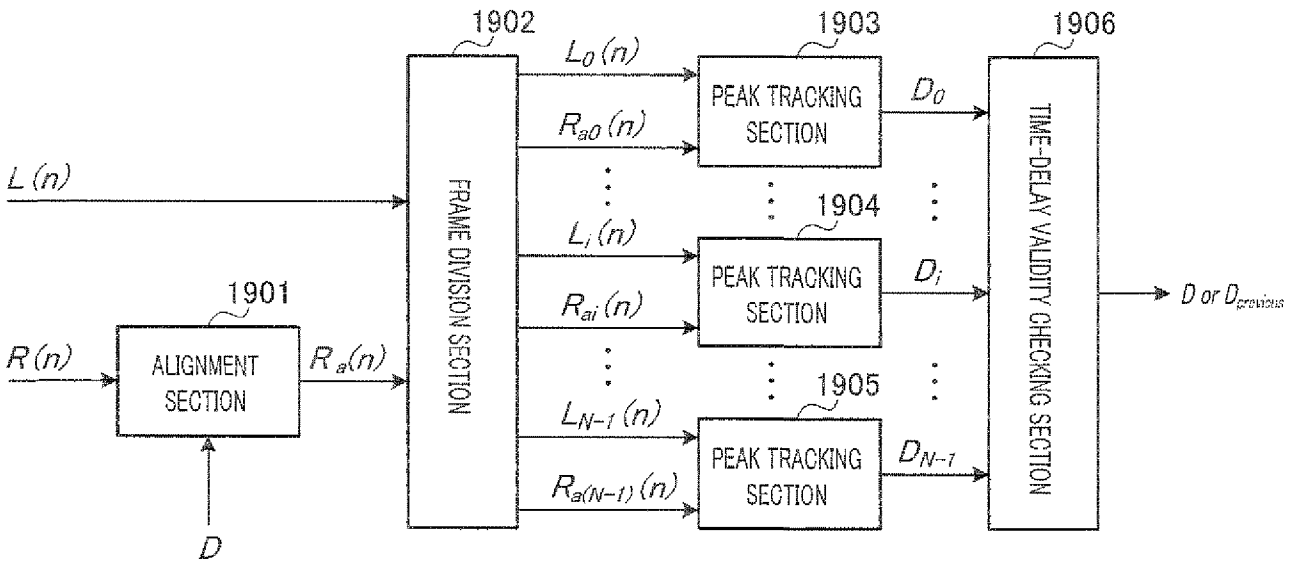
FIG. 19 is a block diagram illustrating a variation of the configuration of the peak tracking section according to Embodiment 2 of the present invention.

FIG. 19 is a block diagram illustrating Variation of the configuration of the peak tracking section of Embodiment 2.

In FIG. 19, alignment section 1901 aligns input signals L(n) and R(n) according to derived time delay D (alignment section 1901 aligns R(n) as an example in FIG. 19). Frame division section 1902 divides aligned signals L(n) and $R_a(n)$ into a plurality of sub frames. Here, the number of sub frames is denoted by N.

Peak tracking sections 1903, 1904, and 1905 obtain sub-frame time delays $D_0$ to $D_{N-1}$ by applying the peak tracking. Time-delay validity checking section 1906 checks on the validity of frame time delay D by using sub-frame time delays $D_0$ to $D_{N-1}$. In a case where the number of sub-frame time delays exceeding the predetermined value is larger than M (M can be a predetermined value or be adaptively derived according to the signal characteristics), time-delay validity checking section 1906 determines that D is invalid. In this case, time-delay validity checking section 1906 outputs the time delay of the previous frame. Meanwhile, in a case where the number of sub-frame time delays exceeding the predetermined value is M or less, time-delay validity checking section 1906 regards D as valid, and outputs D of the current frame.

According to Embodiment 2, the stereo input signal frame is divided into a plurality of sub frames, and the positions of the peaks are obtained in each sub frame. An estimated sub-frame time delay is obtained by comparing the positions of the peaks. The validity of the time delay computed by another time delay estimation method is checked by the plurality of sub-frame time delays. If it is determined that the time delay is valid, the time delay is intently used, and if it is determined that the time delay is invalid, the time delay is discarded. Therefore, according to Embodiment 2, in addition to the effects of Embodiment 1, it is possible to maintain the validity of another time delay estimation method for a single-sound-source environment, without deteriorating the stereo feeling of the input signal in a multiple-sound-source environment. Further, according to Embodiment 2, since the peak tracking method is combined with another time delay estimation method, it is possible to more accurately derive the time delay between stereo inputs. At this time, the amount of computational complexity of the original method by the peak tracking does not significantly increase. Also, in a case where the input signals L(n) and R(n) are aligned according to derived time delay D, it is possible to prevent corresponding peaks (for example, $P_{L(1)}$ in L(n) and $P_{R(1)}$ in R(n)) from being divided into two different sub frames. Further, in the case where input signals L(n) and R(n) are aligned according to derived time delay D, since it is unnecessary to consider the time delay, the frame division section is very easily implemented.

(Embodiment 3)

In Embodiment 3, two different time delays are derived. One time delay is derived by the peak tracking method of momentarily tracking a time delay. The other time delay is derived by another time delay estimation method (for example, a low-passed cross correlation method introduced in Non-Patent Literature 3) of more stably tracking a time delay. Between the peak tracking method and the other method, a final time delay is selected.

Figure 20:
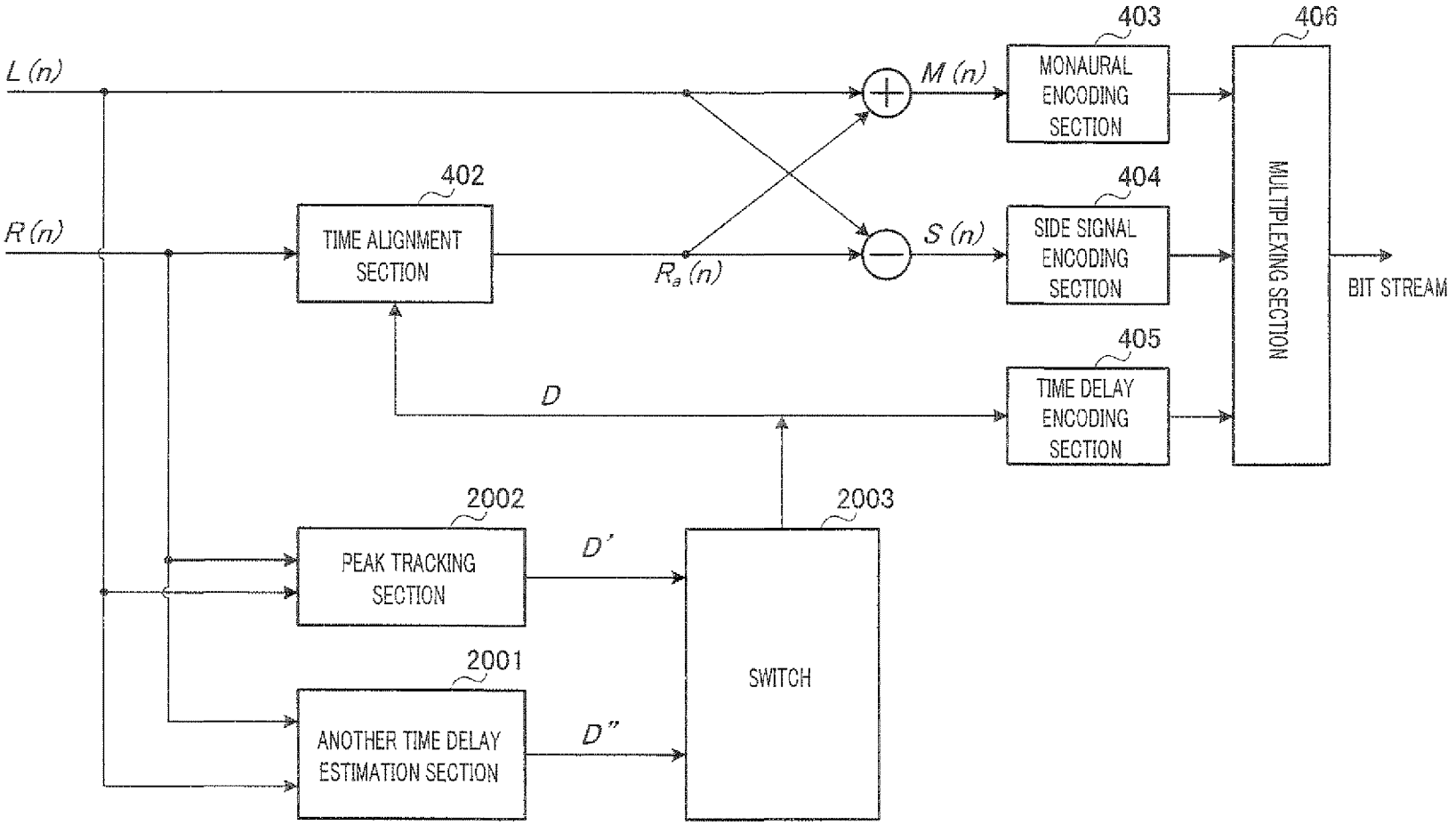
FIG. 20 is a block diagram illustrating a configuration of an encoding apparatus according to Embodiment 3 of the present invention.

FIG. 20 is a block diagram illustrating a configuration of an encoding apparatus of Embodiment 3. Most of the encoding apparatus shown in FIG. 20 is identical to the encoding apparatus of Embodiment 1 shown in FIG. 4. In FIG. 20, identical components to those in FIG. 4 are denoted by the same reference symbols, and a description thereof is omitted. Peak tracking section 2002 estimates time delay D' by the peak tracking method, and another time delay estimation section 2001 derives time delay D" by another time delay estimation method. Switch 2003 selects and outputs a better time delay of D' and D".

Figure 21:
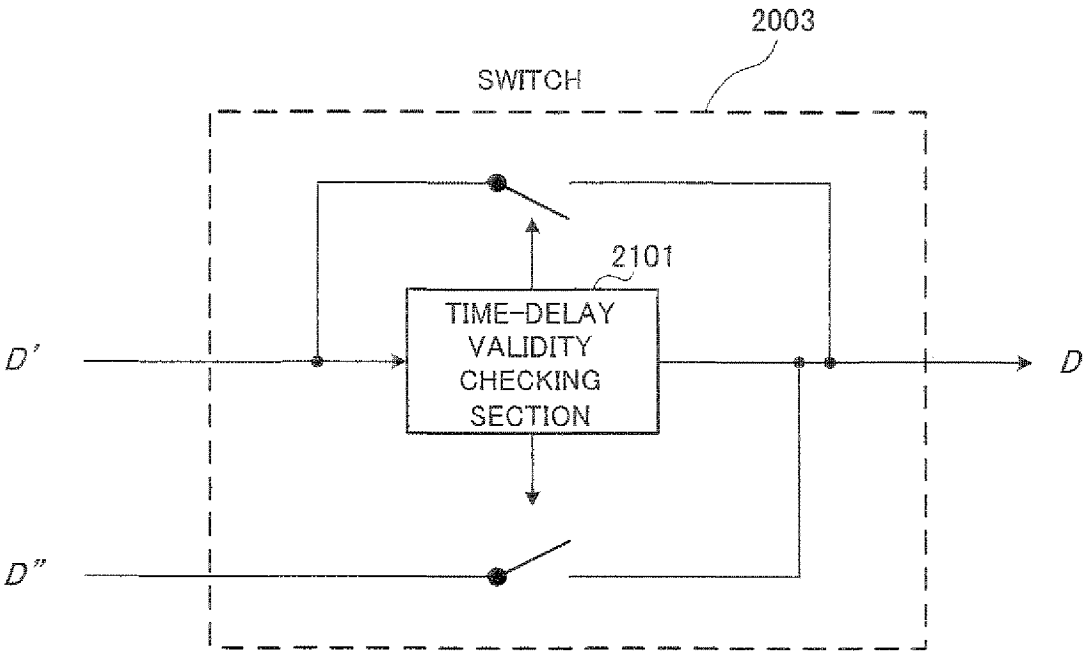
FIG. 21 is a block diagram illustrating a configuration of a switch according to Embodiment 3 of the present invention.

FIG. 21 is a block diagram illustrating a configuration of switch 2003. Time-delay validity checking section 2101 checks time delay D' by the same method as the time-delay validity checking method applied in time-delay validity checking section 606 of FIG. 6. In a case where time delay D' is valid, time-delay validity checking section 2101 outputs time delay D' as final time delay D. Meanwhile, in a case where time delay D' is invalid, time-delay validity checking section 2101 outputs D" as final time delay D.

According to Embodiment 3, since a time delay is selected between the peak tracking method of momentarily tracking an input time delay and another time delay estimation method of stably tracking the input time delay, it is possible to achieve fast and stable time delay estimation.

(Embodiment 4)

In Embodiment 4, two different time delay are derived by using two time delay estimation methods, not the peak tracking method. One method can momentarily track an input time delay, while the other method stably tracks the input time delay. Also, the peak tracking is used as a validity checking method in a switch module.

Figure 22:
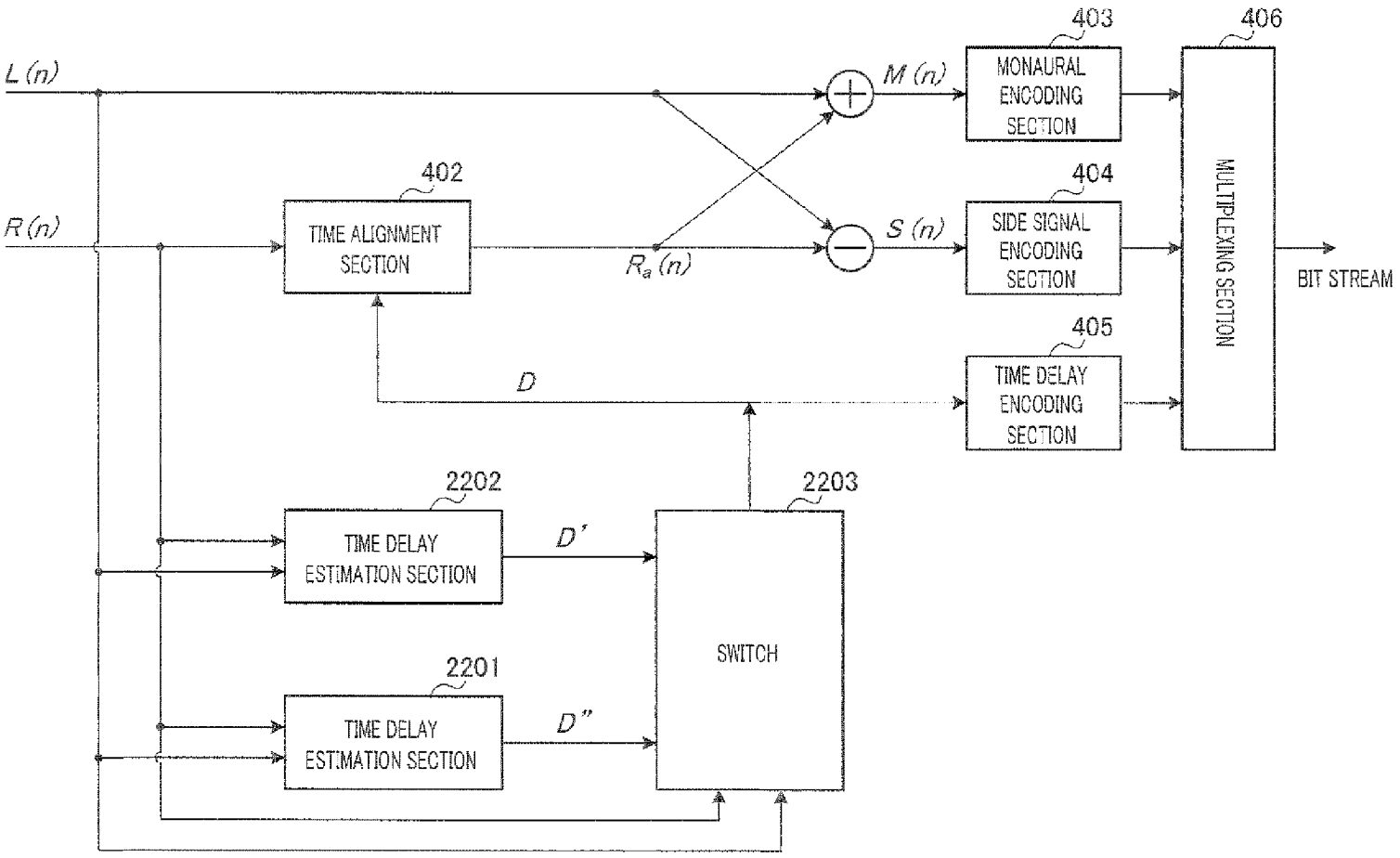
FIG. 22 is a block diagram illustrating a configuration of an encoding apparatus according to Embodiment 4 of the present invention.

FIG. 22 is a block diagram illustrating an encoding apparatus of Embodiment 4. Most of the encoding apparatus of Embodiment 4 is identical to the encoding apparatus shown in FIG. 20. In FIG. 22, identical components to those in FIGS. 4 and 20 are denoted by the same reference symbols, and a description thereof is omitted. Time delay estimation section 2202 estimates time delay D' by another time delay estimation method, not the peak tracking method.

In this encoding apparatus, time delay estimation section 2202 is a method capable of momentarily tracking a time delay. One example is a single-frame cross correlation method. Cross correlation coefficients are derived only in the current frame. The maximum cross correlation coefficient is found and a corresponding time delay is obtained.

Time delay estimation section 2201 is a method of updating a time delay slowly but stably. One example is the low-passed cross correlation method introduced in Non-Patent Literature 3, and computes cross correlation coefficients on the basis of the current frame and the previous frame. In the low-passed cross correlation method, the maximum cross correlation coefficient is found and a corresponding time delay is obtained. Therefore, the derived time delay very stably tracks the input time delay. Switch 2203 selects and outputs a better time delay of D' and D".

Figure 23:
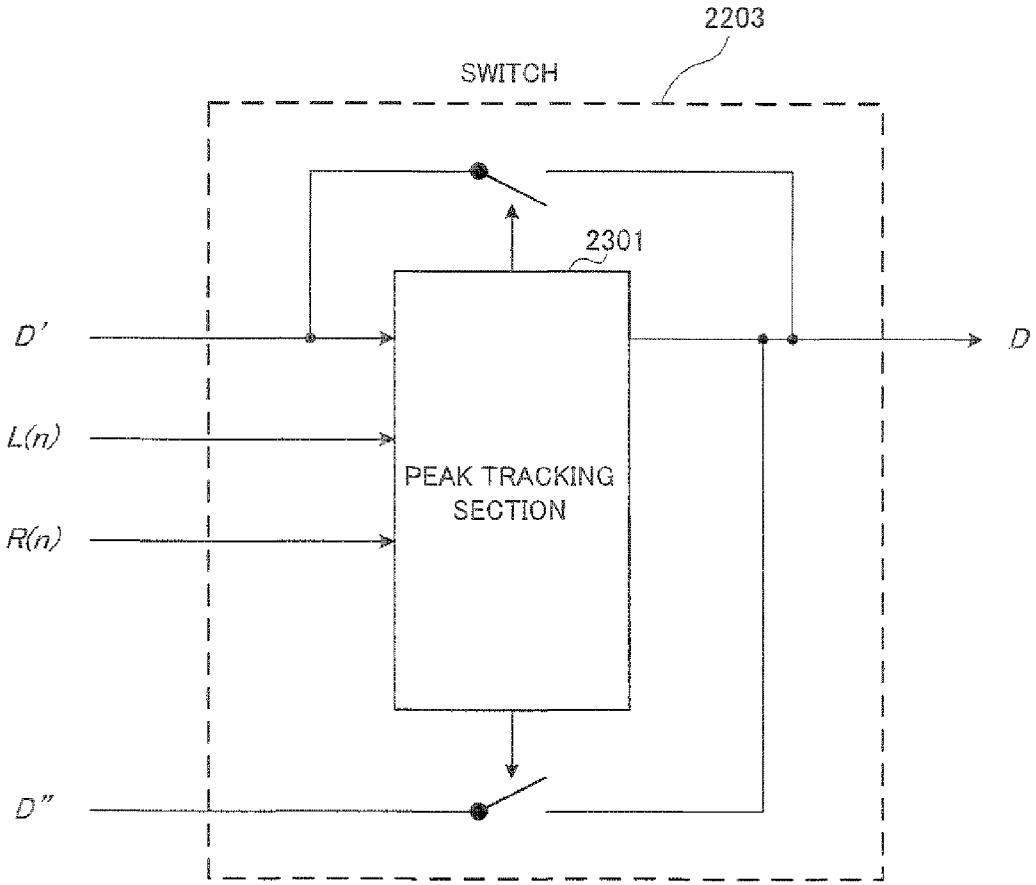
FIG. 23 is a block diagram illustrating a configuration of a switch according to Embodiment 4 of the present invention.

FIG. 23 is a block diagram illustrating a configuration of switch 2203. Peak tracking section 2301 checks time delay D' by the peak tracking method (which is the same as the case of FIG. 18 or 19 in Embodiment 2). In a case where time delay D' is valid, peak tracking section 2301 outputs D' as final time delay D. Meanwhile, in a case where time delay D' is invalid, peak tracking section 2301 outputs D" as final time delay D.

Figure 24:
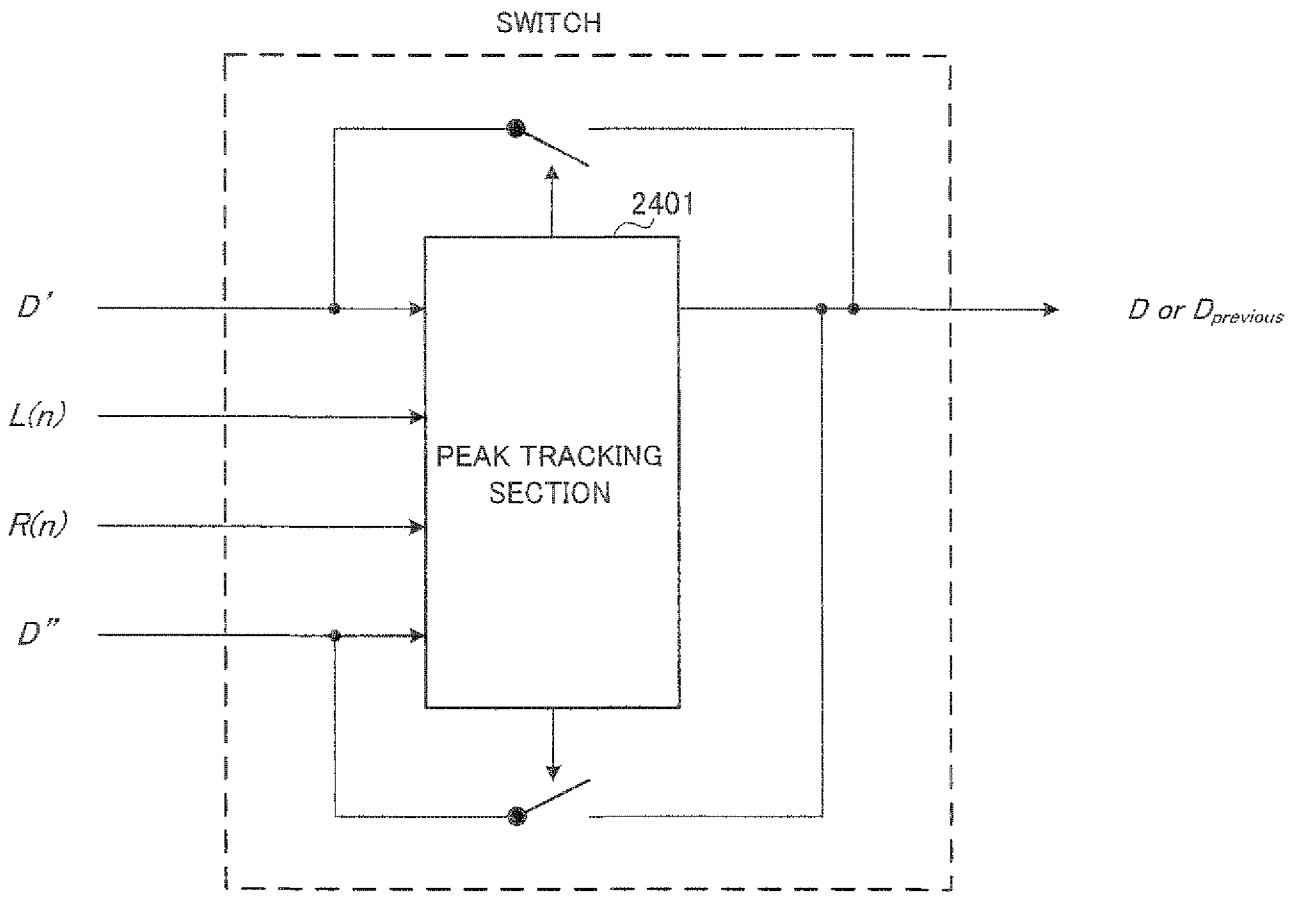
FIG. 24 is a block diagram illustrating another example of the configuration of the switch according to Embodiment 4 of the present invention.

FIG. 24 is a block diagram illustrating another example of the configuration of the switch of Embodiment 4. Peak tracking section 2401 checks both of time delay D' and time delay D" by the peak tracking method (which is the same as the case of FIG. 18 or 19 in Embodiment 2). In a case where one of the two time delays is valid, peak tracking section 2401 outputs the valid time delay as final time delay D. Further, in a case where both of the two time delays are valid, peak tracking section 2401 outputs a time delay more appropriate for the peak tracking method, as the final time delay. Furthermore, in a case where both of the two time delays are not valid, peak tracking section 2401 outputs the time delay of the previous frame as the final time delay.

According to Embodiment 4, since a time delay is selected between a time delay estimation method of momentarily tracking an input time delay and another time delay estimation method of stably tracking the input time delay, it is possible to achieve fast and stable time delay estimation.

(Embodiment 5)

In Embodiment 5, a plurality of time delays are derived by a plurality of different methods. Further, in Embodiment 5, the peak tracking is used as a validity checking method in a switch module, and the best time delay of time delay candidates is selected.

Figure 25:
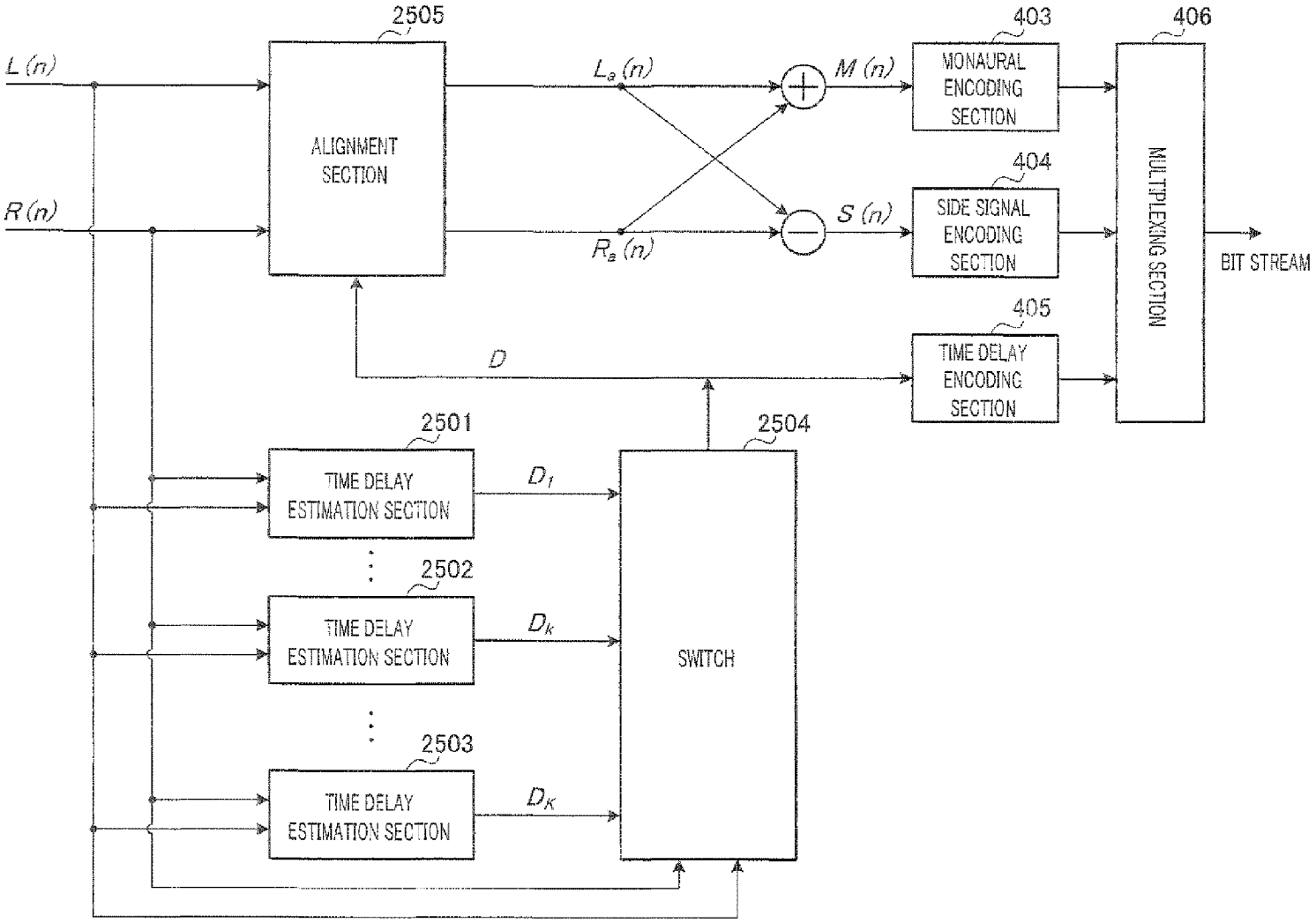
FIG. 25 is a block diagram illustrating a configuration of an encoding apparatus according to Embodiment 5 of the present invention.

FIG. 25 is a block diagram illustrating a configuration of an encoding apparatus of Embodiment 5. Most of the encoding apparatus is identical to the encoding apparatus shown in FIG. 22. In FIG. 25, identical components to those in FIGS. 4, 20 and 22 are denoted by the same reference symbols, and a description thereof is omitted. Time delay estimation sections 2501, 2502, and 2503 derive K (K is 2 or more) number of time delays by the plurality of different methods. The derived time delay can be used for aligning the left signal or the right signal according to the signs thereof.

In this encoding apparatus, it is recommended that time delay estimation sections 2501, 2502, and 2503 have different estimation characteristics.

Time delay estimation section 2501 obtains a time delay by a method capable of most momentarily tracking a time delay. One example of the method capable of most momentarily tracking a time delay is the single-frame cross correlation method. The single-frame cross correlation method derives cross correlation coefficients only in the current frame. Then, the single-frame cross correlation method finds the maximum cross correlation and obtains a corresponding time delay.

Time delay estimation section 2503 obtains a time delay by a method of updating a time delay slowly but stably. One example of the method of updating a time delay slowly but stably is the low-passed cross correlation method introduced in Non-Patent Document 3. The low-passed cross correlation method computes cross correlation coefficients on the basis of the current frame and the previous frame. Then, the low-passed cross correlation method finds the maximum cross correlation coefficient and obtains a corresponding time delay. Therefore, the derived time delay very stably tracks the input time delay. Switch 2504 selects and outputs the best time delay of time delay candidates $D_1$ to $D_K$. Alignment section 2505 aligns the left signal or the right signal according to the sign of the time delay selected by switch 2504. For example, in a case where the time delay is positive, alignment section 2505 aligns the left signal, and in a case where the time delay is negative, alignment section 2505 aligns the right signal.

Figure 26:
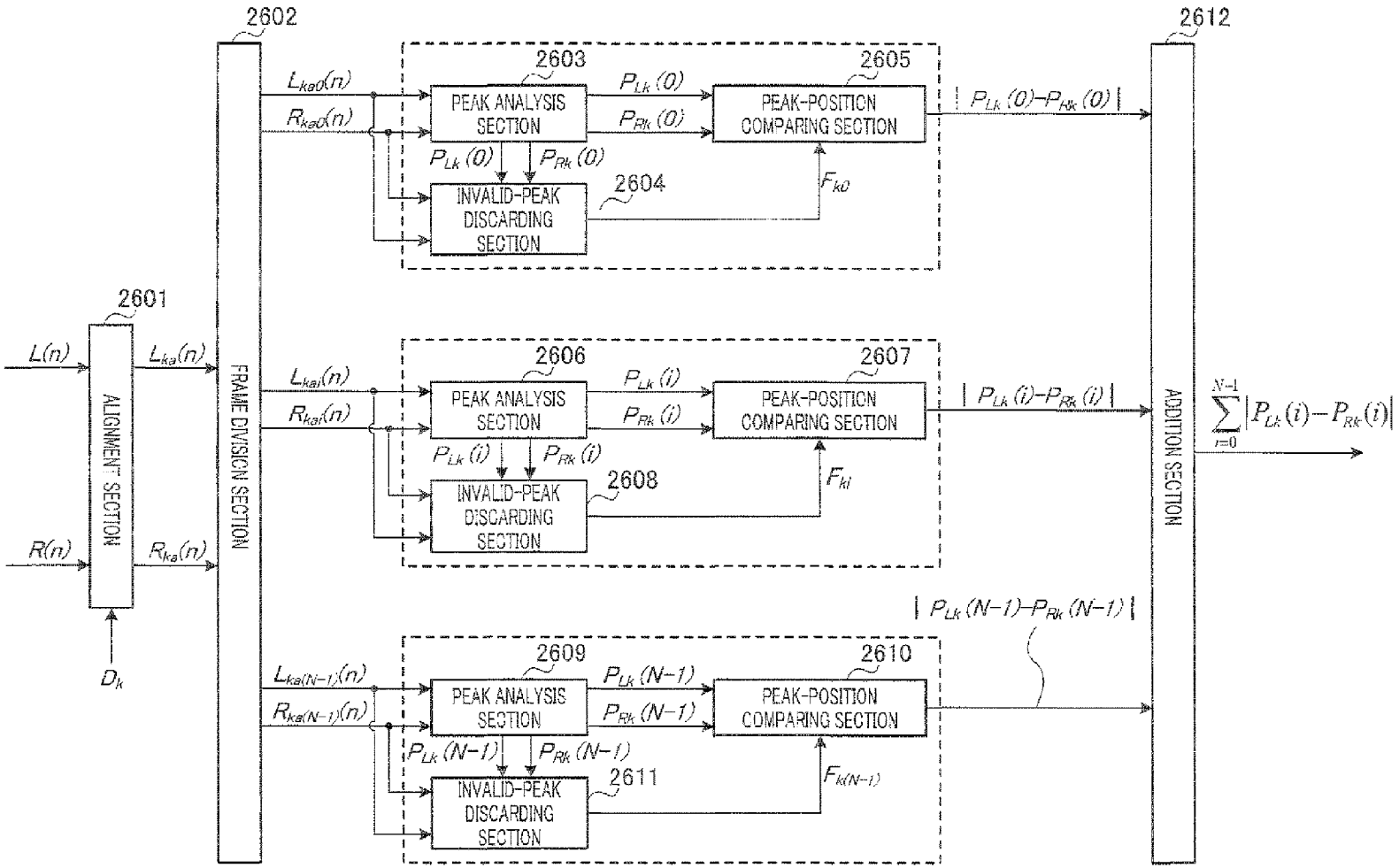
FIG. 26 is a block diagram illustrating a configuration of a switch according to Embodiment 5 of the present invention.

FIG. 26 is a block diagram illustrating a configuration of switch 2504. As an example, time delay $D_k$ is used. Alignment section 2601 aligns input signals L(n) and R(n) according to derived time delay $D_k$. Frame division section 2602 divides aligned signals $L_{ka}(n)$ and $R_{ka}(n)$ into a plurality of sub frames. The number of sub frames is denoted by N.

The peak tracking (using peak analysis sections 2603, 2606, and 2609, invalid-peak discarding sections 2604, 2608, and 2611, and peak-position comparing sections 2605, 2607, and 2610) is applied to each sub frame, so as to obtain sub-frame peak differences $|P_{Lk}(0)-P_{Rk}(0)|$ to $|P_{Lk}(N-1)-P_{Rk}(N-1)|$. Addition section 2612 adds up these sub-frame peak differences.

Figure 27:
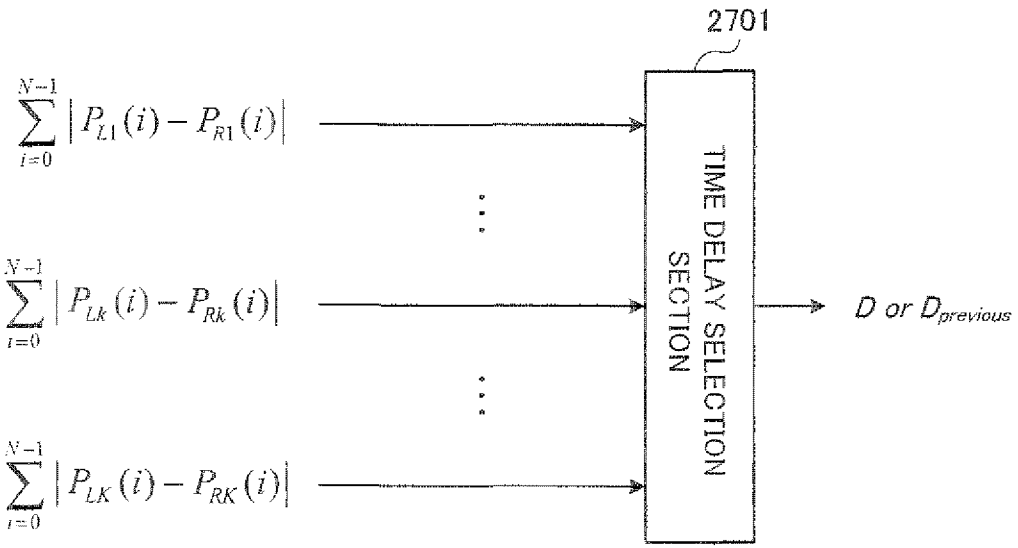
FIG. 27 is a block diagram illustrating a configuration of a time delay selection section according to Embodiment 5 of the present invention.

FIG. 27 is a'block diagram illustrating a configuration of time delay selection section 2701.

Time delay selection section 2701 receives the sum of the sub-frame peak differences of time delays $D_1$ to $D_K$, and can select a time delay according to equation 23.

Equation 23

$$D = arg_{D_k}^{min} \sum_{i=0}^{N-1} |P_{Lk}(i) - P_{Rk}(i)| \quad [23]$$

A reference is not limited to the above, but another reference is possible.

According to Embodiment 5, since the best time delay candidate is selected among the plurality of time delay estimation methods, it is possible to well estimate a time delay.

The above description illustrates preferable Embodiments of the present invention, and the scope of the present invention is not limited thereto. The present invention is also applicable to any systems having a stereo acoustic sound signal encoding apparatus or a stereo acoustic sound signal decoding apparatus.

Also, the stereo acoustic sound signal encoding apparatus and the stereo acoustic sound signal decoding apparatus according to the present invention can be mounted in a communication terminal apparatus and a base station apparatus in a mobile communication system. Therefore, it is possible to provide a communication terminal apparatus, a base station apparatus, and a mobile communication system having the same effects as described above.

Also, although cases have been described where the present invention is configured by hardware, the present invention can also be realized by software. For example, an algorithm according to the present invention may be written in a programming language, and the program may be stored in a memory and be executed by an information processing unit, whereby it is possible to implement the same functions as the stereo acoustic sound signal encoding apparatus and so on according to the present invention.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field. Programmable Gate Array) or a reconfigurable processor where connections and settings of circuit cells within an LSI can be reconfigured is also possible.

Further, if integrated circuit technology comes out to replace LSPs as a result of the advancement of semiconductor technology or a derivative other technology, it is naturally also possible to carry out function block integration using this technology. Application of biotechnology is also possible.

The disclosures of Japanese Patent Application. No. 2009-12407, filed on Jan. 22, 2009, and Japanese Patent Application No. 2009-38646, filed on Feb. 20, 2009, including the specifications, drawings, and abstracts, are incorporated herein by reference in their entirety.

Industrial Applicability

The stereo acoustic sound signal encoding apparatus, the stereo acoustic sound signal decoding apparatus, and method for the same according to the present invention are suitable, in particular, for storing and transmitting stereo acoustic sound signals.

The invention claimed is:

1. A stereo acoustic sound signal encoding apparatus comprising:

a peak tracking section that detects peaks in waveforms of a plurality of sub frames obtained by dividing a frame of a right channel signal and a left channel signal, checks on a validity of a first frame time delay of the frame of the right channel signal and the left channel signal by comparing the first frame time delay with subframe time delays of the plurality of sub frames calculated using the detected peaks, and obtains a second frame time delay on the basis of the checked result;

a time alignment section that performs time alignment on one of the right channel signal and the left channel signal on the basis of the second frame time delay; and an encoding section that encodes (i) the other of the right channel signal and the left channel signal besides the time-aligned one of the right channel signal and the left channel signal, (ii) the time-aligned one of the right channel signal and the left channel signal, and (iii) the second frame time delay.

2. The stereo acoustic sound signal encoding apparatus according to claim 1, wherein the peak tracking section regards the first frame time delay as invalid in a case where the number of sub frames, in each of which a difference between the first frame time delay and the sub-frame time delay is equal to or more than a predetermined value, is equal to or more than a threshold value.

3. The stereo acoustic sound signal encoding apparatus according to claim 2, wherein the peak tracking section outputs, as the second frame time delay, one of zero, a third frame time delay of a previous frame, or a fourth frame time delay that is an average of frame time delays of previous frames.

4. The stereo acoustic sound signal encoding apparatus according to claim 1, wherein the peak tracking section estimates the first frame time delay using peaks other than peaks of the sub frames in which the values of the peaks are smaller than a threshold value.

5. The stereo acoustic sound signal encoding apparatus according to claim 1, wherein the peak tracking section outputs the first frame time delay as the second frame time delay in a case where the number of sub frames, in each of which a difference between the first frame time delay and the sub-frame time delay is equal to or more than a predetermined value, is less than a threshold value.

6. The stereo acoustic sound signal encoding apparatus according to claim 1, wherein:

the time alignment section performs time alignment on both of the right channel signal and the left channel signal on the basis of the second frame time delay; and the encoding section encodes the time-aligned right channel signal, the time-aligned left channel signal, and the frame time delay.

7. The stereo acoustic sound signal encoding apparatus according to claim 1, wherein the peak tracking section estimates the first frame time delay using the detected peaks.

8. The stereo acoustic sound signal encoding apparatus according to claim 1, further comprising a time delay estimation section that estimates the first frame time delay by a method different from a method estimating the first frame time delay using the detected peaks.

9. A stereo acoustic sound signal decoding apparatus comprising:

a separation section that separates a bit stream into a right channel signal, a left channel signal, and a frame time delay, the bit stream generated by detecting peaks in waveforms of a plurality of sub frames obtained by dividing a frame of the right channel signal and the right channel signal, checking on a validity of a first frame time delay of each frame of the right channel signal and the left channel signal by comparing the first frame time delay with sub frame time delays of the plurality of sub frames calculated using the detected peaks, obtaining a second frame time delay on the basis of the checked result, performing time alignment on one of the right channel signal and the left channel signal on the basis of the second frame time delay, and encoding and multiplexing (i) the other of the right channel signal and the left channel signal besides the time-aligned one of the right channel signal and the left channel signal,(ii) the time-aligned one of the right channel signal and the left channel signal, and (iii) the frame time delay;

a decoding section that decodes the separated right channel signal, the separated left channel signal, and the separated frame time delay; and a time restoring section that restores the right channel signal to a time before the time alignment, on the basis of the separated frame time delay.

10. A stereo acoustic sound signal encoding method comprising:

detecting peaks in waveforms of a plurality of sub frames obtained by dividing a frame of a right channel signal and a left channel signal;

checking on the validity of a first frame time delay of the frame of the right channel signal and the left channel signal by comparing the first frame time delay with subframe time delays of the plurality of sub frames calculated using the detected peaks, and obtaining a second frame time delay on the basis of the checked result;

performing time alignment on one of the right channel signal and the left channel signal on the basis of the frame time delay; and encoding (i) the other of the right channel signal and the left channel signal, besides the time-aligned one of the right channel signal and the left channel signal, and (ii) the time-aligned one of the right channel signal and the left channel signal, and (iii) the second frame time delay.

11. A stereo acoustic sound signal decoding method comprising:

separating a bit stream into a right channel signal, a left channel signal, and a frame time delay, the bit stream generated by detecting peaks in waveforms of a plurality of sub frames obtained by dividing a frame of the right channel signal and the right channel signal, checking on a validity of a first frame time delay of each frame of the right channel signal and the left channel signal by comparing the first frame time delay with sub frame time delays of the plurality of sub frames calculated using the detected peaks, obtaining a second frame time delay on the basis of the checked result, performing time alignment on one of the right channel signal and the left channel signal on the basis of the second frame time delay, and encoding and multiplexing (i) the other of the right channel signal and the left channel signal besides the time-aligned one of the right channel signal and the left channel signal, (ii) the time-aligned one of the right channel signal and the left channel signal, and (iii) the second frame time delay;

decoding the separated right channel signal, the separated left channel signal, and the separated frame time delay; and restoring the right channel signal to a time before the time alignment, on the basis of the separated frame time delay.

* * * * *